US011891940B2

(12) United States Patent
Adachi

(10) Patent No.: US 11,891,940 B2
(45) Date of Patent: Feb. 6, 2024

(54) EXHAUST CATALYST MANAGEMENT APPARATUS TO BE APPLIED TO VEHICLE

(71) Applicant: SUBARU CORPORATION, Tokyo (JP)

(72) Inventor: Shinji Adachi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 18/318,253

(22) Filed: May 16, 2023

(65) Prior Publication Data

US 2023/0383686 A1 Nov. 30, 2023

(30) Foreign Application Priority Data

May 30, 2022 (JP) ..... 2022-087358

(51) Int. Cl.
*F01N 9/00* (2006.01)
*F01N 11/00* (2006.01)
(Continued)

(52) U.S. Cl.
CPC ..... *F01N 9/002* (2013.01); *F01N 3/035* (2013.01); *F01N 11/002* (2013.01); *F01N 3/101* (2013.01);
(Continued)

(58) Field of Classification Search
CPC ..... F01N 3/035; F01N 3/101; F01N 9/007; F01N 11/002; F01N 2250/02;
(Continued)

(56) References Cited

U.S. PATENT DOCUMENTS

2007/0130919 A1* 6/2007 Lee ..... F01N 9/002 60/286
2009/0320452 A1* 12/2009 Gioannini ..... F01N 9/002 60/277

(Continued)

FOREIGN PATENT DOCUMENTS

JP 2010-059832 A 3/2010
JP 2010-084686 A 4/2010
JP 2013-113215 A 6/2013

*Primary Examiner* — Jorge L Leon, Jr.
(74) *Attorney, Agent, or Firm* — Rimon P.C.; Tomoki Tanida

(57) ABSTRACT

An exhaust catalyst management apparatus to be applied to a vehicle includes a differential pressure sensor and one or more processors. The differential pressure sensor detects an accumulation state of an exhaust-containing substance in a catalyst device. The one or more processors are coupled to the differential pressure sensor and a vehicle outside sensor. The one or more processors determine whether or not travel environment is suited to carrying out an output control for removal, based on a result of the detection of surroundings of the vehicle by a vehicle outside sensor. Upon determining that the travel environment is suited to carrying out the output control for removal, the one or more processors carry out the output control for removal, while the vehicle is traveling, in accordance with a result of the determination of the accumulation state of the exhaust-containing substance in the catalyst device.

16 Claims, 9 Drawing Sheets

(51) Int. Cl.
*F01N 3/035* (2006.01)
*F01N 3/10* (2006.01)

(52) U.S. Cl.
CPC ..... *F01N 9/007* (2013.01); *F01N 2250/02* (2013.01); *F01N 2430/06* (2013.01); *F01N 2550/04* (2013.01); *F01N 2560/08* (2013.01); *F01N 2570/04* (2013.01); *F01N 2570/10* (2013.01); *F01N 2570/14* (2013.01); *F01N 2900/0422* (2013.01); *F01N 2900/12* (2013.01); *F01N 2900/1606* (2013.01)

(58) Field of Classification Search
CPC ..... F01N 2430/06; F01N 2550/04; F01N 2560/08; F01N 2570/04; F01N 2570/10; F01N 2570/14; F01N 2900/0422; F01N 2900/12; F01N 2900/1606; F01N 9/002
USPC ..... 60/285, 295, 297, 300, 320
See application file for complete search history.

(56) References Cited

U.S. PATENT DOCUMENTS

| | | | | |
|---|---|---|---|---|
| 2013/0084217 | A1* | 4/2013 | Ikeda | F01N 3/106 422/109 |
| 2015/0248794 | A1* | 9/2015 | Hashimoto | F01N 9/007 701/50 |
| 2017/0342884 | A1* | 11/2017 | Lee | B01D 53/9418 |
| 2019/0195115 | A1* | 6/2019 | Paukner | F01N 13/0093 |
| 2020/0049045 | A1* | 2/2020 | Sakurai | F01N 11/00 |
| 2020/0309069 | A1* | 10/2020 | Eser | B01D 53/0454 |

* cited by examiner

EXHAUST CATALYST MANAGEMENT APPARATUS TO BE APPLIED TO VEHICLE

CROSS-REFERENCE TO RELATED APPLICATIONS

The present application claims priority from Japanese Patent Application No. 2022-087358 filed on May 30, 2022, the entire contents of which are hereby incorporated by reference.

BACKGROUND

The disclosure relates to an exhaust catalyst management apparatus to be applied to a vehicle.

Vehicles such as automobiles use an engine to generate a driving force for traveling.

For example, in some engines, an air-fuel mixture is generated by injecting gasoline into the air with the use of, for example, a carburetor, and the engine is allowed to intake the generated air-fuel mixture. In other engines, gasoline is directly injected into a combustion chamber of the engine.

Moreover, some engines reduce an amount of gasoline in the combustion chamber to cause lean combustion. In the meanwhile, an existing gasoline engine causes combustion with a rich amount of gasoline in the combustion chamber.

These engines have to exhaust a gas after combustion from the engine.

An exhaust gas from the engine often includes nitrogen oxides or soot.

In particular, direct injection engines configured to cause the lean combustion often generate nitrogen oxides or soot in a large amount.

Moreover, regardless of presence or absence of the lean combustion, engines using gasoline as fuel sometimes generate sulfur compounds.

SUMMARY

An aspect of the disclosure provides an exhaust catalyst management apparatus to be applied to a vehicle. The vehicle includes a catalyst device to be used in an exhaust system of an engine of the vehicle and a vehicle outside sensor configured to perform a detection of surroundings of the vehicle. The exhaust catalyst management apparatus includes a differential pressure sensor, and one or more processors. The differential pressure sensor is configured to perform a detection of an accumulation state of an exhaust-containing substance in the catalyst device, based on a pressure difference between input pressure of the catalyst device and output pressure of the catalyst device. The one or more processors are coupled to the differential pressure sensor and the vehicle outside sensor. The one or more processors are configured to carry out an output control for removal to improve the accumulation state of the exhaust-containing substance in the catalyst device. The one or more processors are configured to determine the accumulation state of the exhaust-containing substance in the catalyst device in accordance with a result of the detection by the differential pressure sensor. The one or more processors are configured to determine whether or not travel environment is suited to carrying out the output control for removal, based on a result of the detection of the surroundings of the vehicle by the vehicle outside sensor. The one or more processors are configured to, upon determining that the travel environment is suited to carrying out the output control for removal, t carry out the output control for removal to improve the accumulation state of the exhaust-containing substance in the catalyst device, while the vehicle is traveling, in accordance with a result of the determination of the accumulation state of the exhaust-containing substance in the catalyst device.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the disclosure.

DETAILED DESCRIPTION

Figure 1:
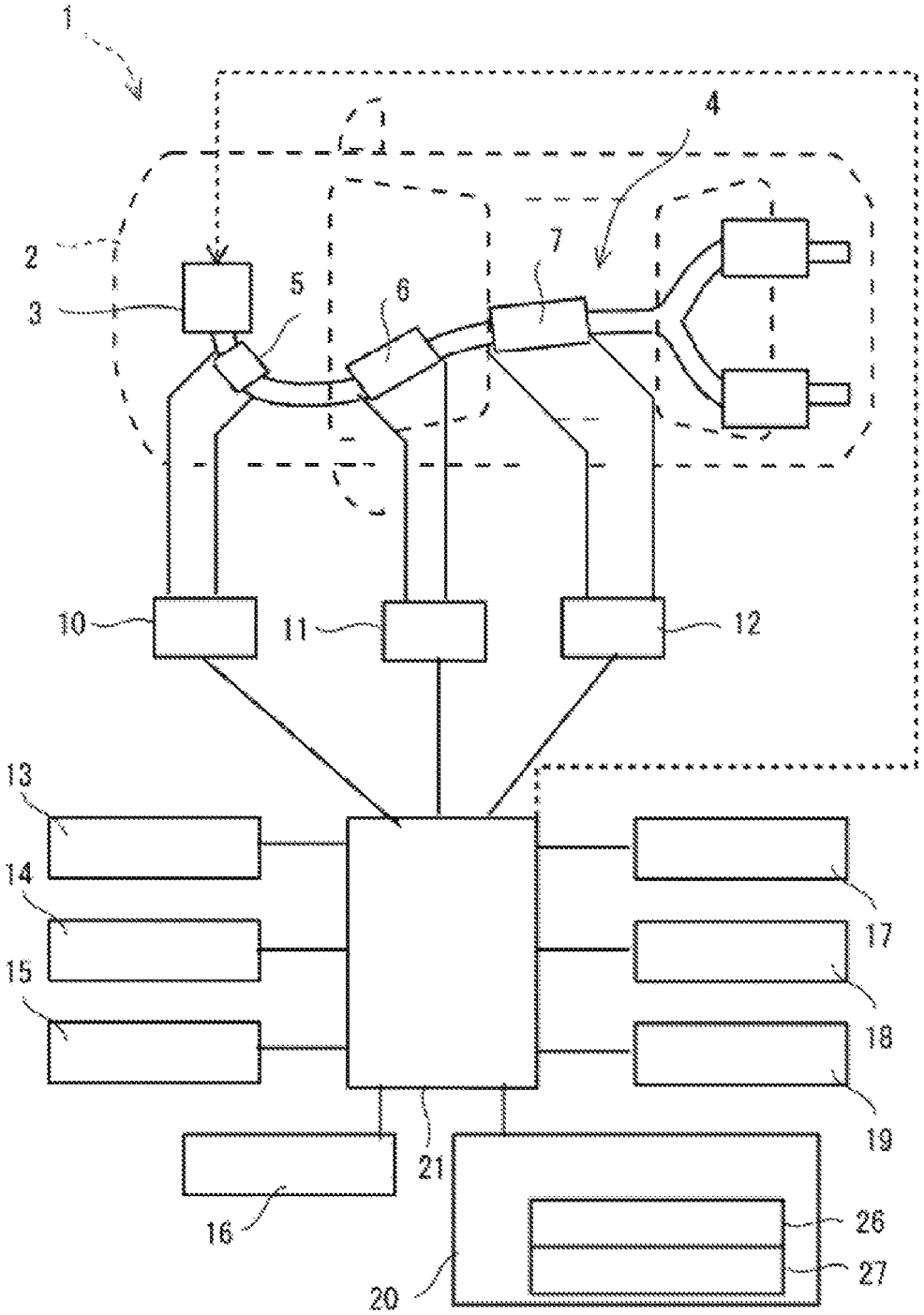
FIG. 1 is a diagram of an automobile to which an exhaust catalyst management apparatus according to a first embodiment of the disclosure is applied.

In an exhaust system of an engine of a vehicle, a catalyst device is used, to capture nitrogen oxides, soot, or sulfur compounds.

In the catalyst device, an exhaust-containing substance accumulates. Non-limiting examples may include nitrogen oxides, soot, or sulfur compounds. When a large amount of the exhaust-containing substance accumulates in the catalyst device, replacement of the catalyst device becomes necessary. When the catalyst device is not in good condition, a driver who drives the vehicle has to bring the vehicle to a maintenance company such as a dealer. In particular, the replacement of the catalyst device incurs labor and costs.

Moreover, traveling with the large amount of the exhaust-containing substance accumulating in the catalyst device may possibly cause a decline in performance of the engine.

Thus, what is desired for a vehicle is to manage the catalyst device to be used in the exhaust system of the engine of the vehicle.

In particular, what is desired for a vehicle is to manage the catalyst device to make it possible to reduce the number of replacements of the catalyst device as much as possible.

Japanese Unexamined Patent Application Publication (JP-A) Nos. 2010-084686, 2013-113215, and 2010-059832 disclose techniques of improving an accumulation state of the exhaust-containing substance in the catalyst device.

In a control of improving the accumulation state of the exhaust-containing substance in the catalyst device, it is basically desirable to maintain a high exhaust gas temperature from the engine.

JP-A No. 2010-084686 provides description that the control of improving the accumulation state of the exhaust-containing substance in the catalyst device is automatically carried out and that the control is carried out by an operation by a driver.

JP-A No. 2013-113215 provides description that the control of improving the accumulation state of the exhaust-containing substance in the catalyst device is carried out based on a switch operation by a driver.

In these cases, the drivers themselves have to determine whether or not current travel environment is suited to carrying out a control for removal. It is desirable for the drivers to have recognition sufficient enough to determine whether or not to carry out the control for removal while traveling, and make the determination.

JP-A No. 2010-059832 provides description that a route along which an automobile is guided is changed to carry out the control of improving the accumulation state of the exhaust-containing substance in the catalyst device. In this case, guiding the automobile along the different route from a usual route may give the driver the sense of discomfort. The driver does not necessarily travel along the route that is more time-consuming and costlier than usual. For the driver who does not recognize the necessity of removal of the exhaust-containing substance from the catalyst device, it is incomprehensible and stressful to be guided along an unnecessarily long route.

In any case, a burden on the driver is large.

It is desirable to provide an exhaust catalyst management apparatus that makes it possible to manage a catalyst device to be used in an exhaust system of an engine of a vehicle, while reducing a burden on a driver.

In the following, some example embodiments of the disclosure are described in detail with reference to the accompanying drawings. Note that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiments which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same reference numerals to avoid any redundant description. In addition, elements that are not directly related to any embodiment of the disclosure are unillustrated in the drawings.

First Embodiment

FIG. 1 illustrates an automobile 1 to which an exhaust catalyst management apparatus according to a first embodiment of the disclosure is applied.

In one embodiment of the disclosure, the automobile 1 in FIG. 1 may serve as a "vehicle". The automobile 1 may be configured to not only travel based on operations by a driver who drives the automobile 1, but also travel with driver assistance and travel by automated driving. Driver assistance includes assisting the driver in making the operations.

The automobile 1 may include a vehicle body 2. In a front portion of the vehicle body 2, an engine 3 may be provided. The engine 3 may include, for example, a direct injection gasoline engine. In the engine 3, an air-fuel mixture may be generated by injecting gasoline into the air with the use of, for example, a carburetor, and the engine 3 may be allowed to intake the generated air-fuel mixture.

In recent years, to improve environmental performance, the engine 3 is configured to not only cause combustion with rich supply of gasoline as with existing techniques but also cause lean combustion with lean gasoline. To the engine 3, an exhaust system 4 may be coupled. The exhaust system 4 includes an exhaust pipe. The air-fuel mixture combusted in the engine 3 is exhausted to outside the vehicle through the exhaust pipe. An exhaust gas from the gasoline engine sometimes includes an exhaust-containing substance, e.g., a nitrogen oxide such as $NO_X$ and a sulfur compound. Thus, the exhaust system 4 includes various kinds of catalyst devices. The exhaust system 4 in this embodiment may include three catalyst devices, i.e., a three-way catalyst device 5, a first $NO_X$ storage reduction catalyst device 6, and a second $NO_X$ storage reduction catalyst device 7, in the order of closeness to the engine 3.

The three-way catalyst device 5 may remove hydrocarbons, carbon monoxide, and nitrogen oxides from the exhaust gas. The three-way catalyst device 5 may include a microparticle collection filter, and capture and accumulate, for example, soot contained in the exhaust gas. In such a three-way catalyst device 5, particulate matter (PM) such as nitrogen oxide and soot easily accumulates. The three-way catalyst device 5 may serve as a PM catalyst device.

The first $NO_X$ storage reduction catalyst device 6 or the second $NO_X$ storage reduction catalyst device 7 may reduce $NO_X$ by a Lean $NO_X$ Trap. However, sulfur compounds may sometimes accumulate in $NO_X$ storage reduction catalyst devices that reduce $NO_X$ by the Lean $NO_X$ Trap.

By these catalyst devices, nitrogen oxides, soot, sulfur compounds, etc. are optimally removed from the exhaust gas from the automobile 1.

In particular, in a direct injection engine configured to cause lean combustion, nitrogen oxides or soot are easily generated in a large amount, but the catalyst devices make it possible to optimally remove the nitrogen oxides or the soot from the exhaust gas.

Moreover, regardless of presence or absence of lean combustion, sulfur compounds are generated in the exhaust gas from the engine 3 using gasoline as fuel. But the catalyst devices make it possible to optimally remove the sulfur compounds from the exhaust gas.

However, in the catalyst devices, the exhaust-containing substance such as nitrogen oxides, soot, or sulfur compounds removed from the exhaust gas may accumulate while part of the exhaust-containing substance is deteriorated.

In particular, in the direct injection engine configured to cause lean combustion, nitrogen oxides and soot are easily generated. For example, when a vehicle repeats short-distance travel on which the vehicle finishes traveling before the engine 3 is warmed up, there arises possibility of accumulation of nitrogen oxides and soot in the three-way catalyst device 5 to the extent that removal becomes necessary.

When a large amount of the exhaust-containing substance accumulates in the catalyst device, replacement of the catalyst device becomes necessary. Moreover, traveling with a large amount of the exhaust-containing substance accumulating in the catalyst device may possibly cause a decline in performance of the engine 3. In these cases, the driver has to bring the automobile 1 to a maintenance company such as a dealer. The replacement of the catalyst device incurs labor and costs to the driver.

As described, what is desired for vehicles such as the automobile 1 is to manage the catalyst device to be used in the exhaust system 4 of the engine 3 of the vehicle.

In particular, what is desired for the automobile 1 is to manage the catalyst device to make it possible to reduce the number of replacements of the catalyst device as much as possible.

Moreover, truck drivers and drivers of the automobile 1 using a diesel engine are expected to have knowledge and awareness of the fact that the exhaust-containing substance sometimes accumulates in the catalyst device and that removal of the exhaust-containing substance is necessary. However, conceivably, general drivers often do not have such knowledge or awareness. In the management of the catalyst device, it is desired to make it possible for even general drivers to perform optimal management. In the management of the catalyst device, it is desired to make it possible to appropriately manage the catalyst device while reducing a burden on the driver.

To manage an exhaust catalyst, the automobile 1 in this embodiment may include, for example, a first differential pressure sensor 10, a second differential pressure sensor 11, a third differential pressure sensor 12, and a processor 21. To the processor 21, the first differential pressure sensor 10, the second differential pressure sensor 11, and the third differential pressure sensor 12 may be coupled. To the processor 21, a vehicle external camera 13, a Lidar 14, a speed sensor 15, a global navigation satellite system (GNSS) receiver 16, a timer 17, a meter panel 18, a speaker 19, and a memory 20 may be further coupled. In one embodiment of the disclosure, the first differential pressure sensor 10, the second differential pressure sensor 11, and the third differential pressure sensor 12 may each serve as a "differential pressure sensor".

The first differential pressure sensor 10 may detect pressure at an inlet and pressure at an outlet of the three-way catalyst device 5, and detect a pressure difference between input pressure and output pressure of the three-way catalyst device 5. The pressure difference between the input pressure and the output pressure of the three-way catalyst device 5 increases as an amount of accumulation of the exhaust-containing substance in the three-way catalyst device 5 increases. The first differential pressure sensor 10 may assume a pressure difference in a state where no exhaust-containing substance accumulates in the three-way catalyst device 5 to be a reference, and detect, as the pressure difference, a difference from the reference. Thus, the first differential pressure sensor 10 is able to detect an accumulation state of the exhaust-containing substance in the three-way catalyst device 5 by the pressure difference between the pressure on inflow side and the pressure on outflow side of the three-way catalyst device 5.

The second differential pressure sensor 11 may detect pressure at an inlet and pressure at an outlet of the first $NO_X$ storage reduction catalyst device 6, and detect a pressure difference between input pressure and output pressure of the first $NO_X$ storage reduction catalyst device 6. The pressure difference between the input pressure and the output pressure of the first $NO_X$ storage reduction catalyst device 6 increases as the amount of accumulation of the exhaust-containing substance in the first $NO_X$ storage reduction catalyst device 6 increases. The second differential pressure sensor 11 may assume a pressure difference in a state where no exhaust-containing substance accumulates to be a reference, and detect, as the pressure difference, a difference from the reference. Thus, the second differential pressure sensor 11 is able to detect an accumulation state of the exhaust-containing substance in the first $NO_X$ storage reduction catalyst device 6 by the pressure difference between the pressure on inflow side and the pressure on outflow side of the first $NO_X$ storage reduction catalyst device 6.

The third differential pressure sensor 12 may detect pressure at an inlet and pressure at an outlet of the second $NO_X$ storage reduction catalyst device 7, and detect a pressure difference between input pressure and output pressure of the second $NO_X$ storage reduction catalyst device 7. The pressure difference between the input pressure and the output pressure of the second $NO_X$ storage reduction catalyst device 7 increases as an accumulation state of the exhaust-containing substance in the second $NO_X$ storage reduction catalyst device 7 increases. The third differential pressure sensor 12 may assume a pressure difference in a state where no exhaust-containing substance accumulates to be a reference, and detect, as the pressure difference, a difference from the reference. Thus, the third differential pressure sensor 12 is able to detect the accumulation state of the exhaust-containing substance in the second $NO_X$ storage reduction catalyst device 7 by the pressure difference between the pressure on inflow side and the pressure on outflow side of the second $NO_X$ storage reduction catalyst device 7.

The vehicle external camera 13 is provided in the automobile 1 to be directed outwardly. The vehicle external camera 13 may detect surroundings of the automobile 1 by imaging. In one example, the vehicle external camera 13 may capture an image of a forward view of the automobile 1 in a direction of travel of the automobile 1, and an image of a rearward view of the automobile 1. The automobile 1 may include the vehicle external camera 13 in a plurality. The vehicle external camera 13 may analyze the captured image to detect a predetermined object included in the captured image. In this way, the vehicle external camera 13 is able to detect, for example, other automobiles 1, traffic lights, and stop lines. Non-limiting examples of other automobiles 1 may include a preceding vehicle ahead of the vehicle and a following vehicle behind the vehicle. In one embodiment of the disclosure, the vehicle external camera 13 may serve as a "vehicle outside sensor" that detects the surroundings of the automobile 1.

The Lidar 14 may send out light outwardly from the automobile 1 and generate, based on reflected light, space data regarding the detected surroundings of the automobile 1. The Lidar 14 may analyze the space data regarding the outside of the vehicle, and detect a predetermined object included in the space data. In this way, the Lidar 14 is able to detect, for example, other automobiles 1, traffic lights, and stop lines. Non-limiting examples of other automobiles 1 may include a preceding vehicle ahead of the vehicle and a following vehicle behind the vehicle. In one embodiment of the disclosure, the Lidar 14 may serve as the "vehicle outside sensor" that detects the surroundings of the automobile 1.

The speed sensor 15 may detect a moving speed of the automobile 1. The speed sensor 15 may detect the moving speed of the automobile 1 by time-integrating an acceleration rate detected using an acceleration rate sensor.

The GNSS receiver 16 may receive radio waves from unillustrated GNSS satellites, and generate a position and the time of the vehicle in which the GNSS receiver 16 is provided, based on data regarding the time and positions of the satellites included in the radio waves. The GNSS satellites may include a zenith satellite. The GNSS receiver 16 may also receive radio waves from a fixed station or a base station on the ground and correct the position and the time of the vehicle to be generated.

The timer 17 may measure, for example, the time and a time duration. The time to be measured by the timer 17 may be calibrated by the time by the GNSS receiver 16.

The meter panel 18 may be provided in an unillustrated cabin in which an occupant such as the driver rides, in the vehicle body 2 of the automobile 1. The meter panel 18 may include a display device provided in the automobile 1. The meter panel 18 may be provided in front of a seat on which the driver is seated. This makes it possible for the driver to visually check the meter panel 18 while driving the automobile 1. The automobile 1 may include other display devices than the meter panel 18, e.g., a center console touch screen.

The speaker 19 may be provided in the unillustrated cabin of the automobile 1. The speaker 19 may output, for example, an alarm sound, an operation starting sound, an operation ending sound, and a synthetic sound, without limitation.

The memory 20 may hold, for example, programs for a control described later and various pieces of data to be used in executing the programs. In one embodiment of the disclosure, the memory 20 may serve as "one or more memories". The memory 20 may include, for example, a non-volatile semiconductor memory, a random access memory (RAM), and a hard disk drive (HDD). The various pieces of data to be used in executing the programs may include, for example, a removal flag 26 and high-precision map data 27. The high-precision map data 27 may be used in route guidance for the automobile 1. The high-precision map data 27 may include, for example, data regarding road shapes and data regarding traffic lights around roads.

The processor 21 may include a computer device such as an electronic control unit (ECU) configured to read a program and execute the program. The processor 21 may read and execute the programs held in the memory 20. In one example of the disclosure, the processor 21 may serve as "one or more processors".

For example, to manage the catalyst device, the processor 21 may determine the accumulation states of the exhaust-containing substance in the various catalyst devices described above in accordance with detection results of any one or more of the first differential pressure sensor 10, the second differential pressure sensor 11, and the third differential pressure sensor 12.

When the exhaust-containing substance has accumulated in the catalyst device, the processor 21 may carry out an output control for removal while the automobile 1 is traveling. The output control for removal includes improving the accumulation state of the exhaust-containing substance in the catalyst device. The output control for removal is different from a normal, performance-prioritized output control that gives priority to performance.

Moreover, in carrying out the output control for removal, the processor 21 may display a state of the catalyst device related to the processing on the meter panel 18.

Figure 2:
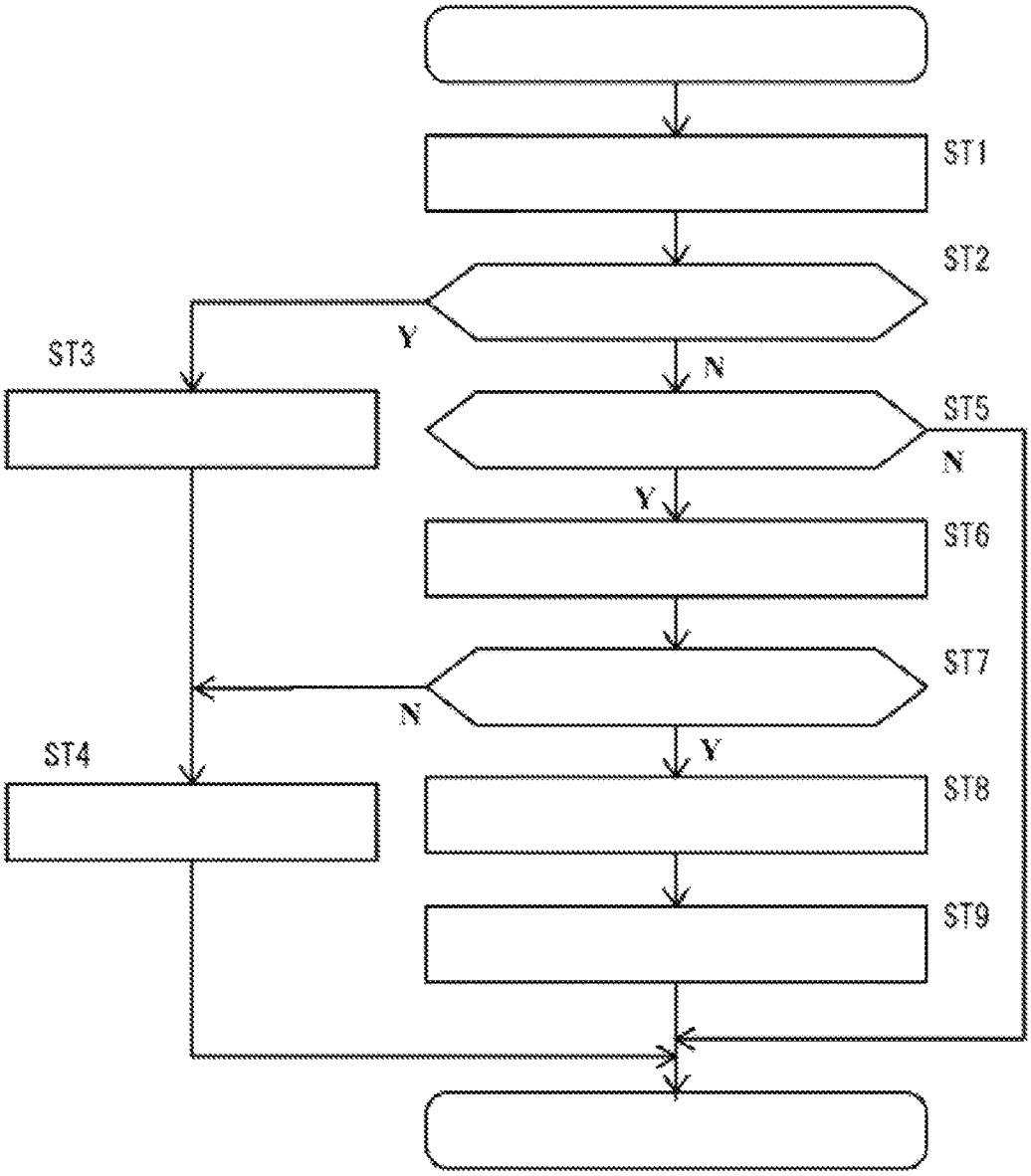
FIG. 2 is a flowchart of a catalyst management control by a processor in FIG. 1.

FIG. 2 is a flowchart of a catalyst management control by the processor 21 in FIG. 1.

The processor 21 may repeatedly carry out the catalyst management control in FIG. 2.

In this embodiment, an example case is described where the exhaust-containing substance to accumulate in the catalyst device related to the processing includes mainly particulate matter (PM) such as nitrogen oxides and soot.

Out of the catalyst devices mentioned above, for example, the three-way catalyst device 5 may serve as the PM catalyst device.

In step ST1, the processor 21 may acquire detection values from the differential pressure sensors 10 to 12 corresponding to the catalyst devices to be controlled.

For example, when the three-way catalyst device 5 is to be controlled, the processor 21 may acquire the detection value of the pressure difference between the input pressure and the output pressure, from the first differential pressure sensor 10.

When the first $NO_X$ storage reduction catalyst device 6 is to be controlled, the processor 21 may acquire the detection value of the pressure difference between the input pressure and the output pressure, from the second differential pressure sensor 11.

When the second $NO_X$ storage reduction catalyst device 7 is to be controlled, the processor 21 may acquire the detection value of the pressure difference between the input pressure and the output pressure, from the third differential pressure sensor 12.

The processor 21 may repeatedly carry out the catalyst management control in FIG. 2 one by one for the catalyst devices provided in the automobile 1.

When only particulate matter (PM) is to be removed, the processor 21 may repeatedly carry out the catalyst management control in FIG. 2 for at least the three-way catalyst device 5.

In step ST2, the processor 21 may compare the acquired detection value of the pressure difference with a replacement threshold value of the catalyst device, to determine whether or not the catalyst device is in an accumulation state that necessitates replacement. The replacement threshold value of the catalyst device may be, for example, a detection value of the pressure difference when the catalyst device is in a PM accumulation state that necessitates replacement. Thus, the processor 21 may determine the accumulation state of the exhaust-containing substance in the catalyst device in accordance with the detection results of the differential pressure sensors 10 to 12. In one embodiment of the disclosure, the differential pressure sensors 10 to 12 may each serve as the "differential pressure sensor". When the detection value of the pressure difference is equal to or greater than the replacement threshold value, the processor 21 may cause the flow to proceed to step ST3, to prompt the replacement of the catalyst device. When the detection value of the pressure difference is not equal to or greater than the replacement threshold value, the processor 21 may cause the flow to proceed to step ST5 because the replacement of the catalyst device is unnecessary.

In step ST3, the processor 21 may generate a display screen for replacement by a dealer, and display the display screen on the meter panel 18. The display screen notifies that the replacement of the catalyst device is necessary. The processor 21 may also output sound from the speaker 19.

Figure 3:
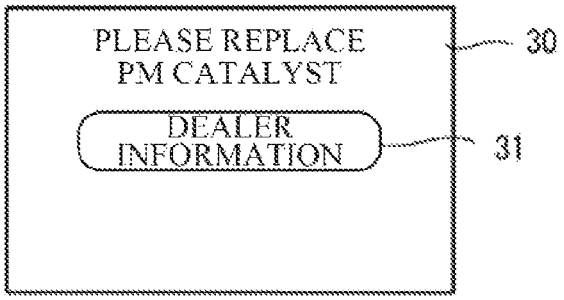
FIG. 3 illustrates an example of a replacement notification screen of a PM catalyst device, to be displayed on a meter panel in FIG. 1, in processing in FIG. 2.

FIG. 3 is an example of a replacement notification screen 30 of the PM catalyst device. The replacement notification screen 30 is to be displayed on the meter panel 18 in FIG. 1, in the processing in FIG. 2. The processor 21 may display the replacement notification screen 30 of the PM catalyst device on the meter panel 18. On the replacement notification screen 30 of the PM catalyst device in FIG. 3, a dealer information button 31 may be displayed together with a message that notifies the driver of the replacement of the PM catalyst device. The dealer information button is operable by the driver. Thus, the driver is able to recognize, while traveling or when on board the automobile 1, that the replacement of the three-way catalyst device 5 that serves as the PM catalyst device is necessary.

Figure 4:
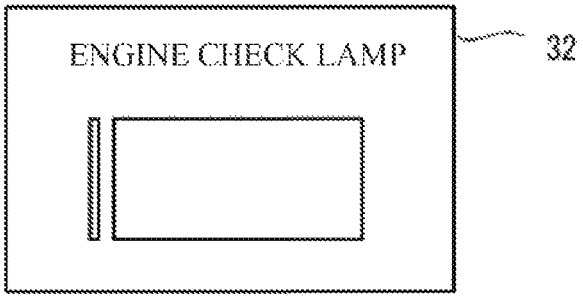
FIG. 4 illustrates an example of an engine check lamp screen, to be displayed on the meter panel in FIG. 1, in the processing in FIG. 2.

FIG. 4 is a check lamp screen 32 of the engine 3, to be displayed on the meter panel 18 in FIG. 1, in the processing in FIG. 2. The processor 21 may display the check lamp screen 32 of the engine 3 in FIG. 4 on the meter panel 18. Thus, the driver is able to recognize that the engine 3 needs to be checked while traveling or when on board the automobile 1. A maintenance company such as a dealer is able to check a malfunction of the engine 3 and replace the three-way catalyst device 5 that serves as the PM catalyst device, based on the fact that the check lamp screen 32 of the engine 3 is displayed in the automobile 1 that has been brought in.

In step ST4, the processor 21 may display dealer information regarding dealers who are able to replace the catalyst device. The processor 21 may display the dealer information in step ST4 solely when the dealer information button 31 is operated on the replacement notification screen 30 of the PM catalyst device in FIG. 3.

For example, the processor 21 may search the map data 27 held in the memory 20 for a route to a location of a dealer, based on the current position by the GNSS receiver 16. The processor 21 may display the route to the dealer on the meter panel 18.

Moreover, the processor 21 may display, for example, a telephone number of the dealer and contact information such as a short message service, and data regarding the automobile 1, on the meter panel 18.

In this way, the processor 21 is able to display the information regarding the maintenance company on the meter panel 18 after displaying the necessity of the replacement of the catalyst device on the meter panel 18.

Thereafter, the processor 21 may end the control.

In step ST5, the processor 21 may compare the acquired detection value of the pressure difference with an alarm threshold value of the catalyst device, to determine whether or not to perform maintenance of the catalyst device, based on the detection value of the pressure difference. In some cases, the driver is able to remove the accumulating PM from the catalyst device by causing the automobile 1 to self-travel in a predetermined way of traveling, when an amount of the PM accumulating in the catalyst device is small. The alarm threshold value may be, for example, a detection value of the pressure difference when the catalyst device is in a state where an amount of the accumulating PM is small enough to be removed by self-traveling. This makes it possible for the processor 21 to determine the accumulation state of the exhaust-containing substance in the catalyst device in accordance with the detection results of the differential pressure sensors 10 to 12. With the alarm threshold value, it is possible to determine whether or not the accumulation state is improvable by removal by self-traveling by the driver themselves. The alarm threshold value, i.e., a second threshold value, is smaller than the replacement threshold value, i.e., a first threshold value, of the pressure difference at which the processor 21 determines that the accumulation state is unimprovable by the removal by self-traveling by the driver themselves. When the detection value of the pressure difference is equal to or greater than the alarm threshold value, the processor 21 may cause the flow to proceed to step ST6, to prompt the removal of the PM from the catalyst device. When the detection value of the pressure difference is not equal to or greater than the alarm threshold value, it is unnecessary to remove the PM from the catalyst device, and the processor 21 may end the control.

In step ST6, the processor 21 may generate a display screen that gives an alarm about necessity of the maintenance of the catalyst device, and display the display screen on the meter panel 18. The processor 21 may also output sound from the speaker 19.

Figure 5:
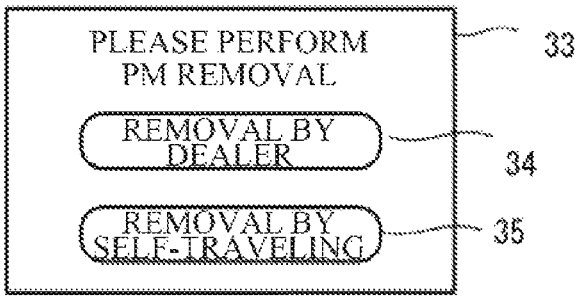
FIG. 5 illustrates an example of an alarm notification screen about PM removal, to be displayed on the meter panel in FIG. 1, in the processing in FIG. 2.

FIG. 5 is an example of an alarm notification screen 33 about PM removal, to be displayed on the meter panel 18 in FIG. 1, in the processing in FIG. 2. The processor 21 may display the alarm notification screen 33 of the PM removal on the meter panel 18. On the alarm notification screen 33 of the PM removal in FIG. 5, a removal-by-dealer button 34 and a removal-by-self-traveling button 35 may be displayed together with a message that gives an alarm about the PM removal. The removal-by-dealer button 34 is operable by the driver. The removal-by-self-traveling button 35 is provided for the removal by self-traveling by the driver themselves. This makes it possible for the driver to recognize that the three-way catalyst device 5 that serves as the PM catalyst device needs maintenance for the PM removal.

Figure 6:
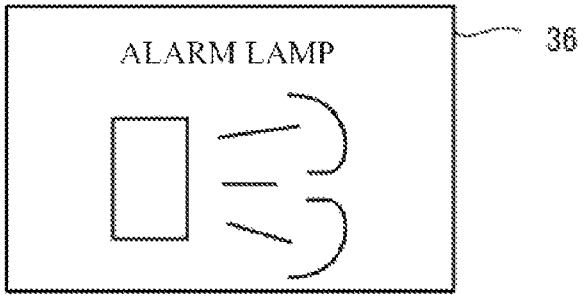
FIG. 6 illustrates an example of an alarm lamp screen about the PM removal, to be displayed on the meter panel in FIG. 1, in the processing in FIG. 2.

FIG. 6 is an alarm lamp screen 36 about the PM removal, to be displayed on the meter panel 18 in FIG. 1, in the processing in FIG. 2. The processor 21 may display the alarm lamp screen 36 for the PM removal in FIG. 6 on the meter panel 18. This makes it possible for the driver to recognize that the maintenance of the catalyst device is necessary, while traveling or when on board the automobile 1. A maintenance company such as a dealer is able to check the catalyst device based on the fact that the alarm lamp screen 36 about the PM removal is displayed in the automobile 1 that has been brought in, and perform the maintenance of the three-way catalyst device 5 that serves as the PM catalyst device.

It is to be noted that PM basically accumulates gradually in the catalyst device. Thus, the processes of steps ST5 and ST6 may be carried out at least once before the processes of steps ST3 and ST4. As a result, the screens in FIGS. 5 and 6 may be displayed on the meter panel 18 at least once before the screens in FIGS. 3 and 4.

In step ST7, the processor 21 may determine whether or not the driver has selected the maintenance by self-traveling. On the alarm notification screen 33 about the PM removal in FIG. 5, the removal-by-dealer button 34 and the removal-by-self-traveling button 35 may be displayed. The driver may operate any of the removal-by-dealer button 34 and the removal-by-self-traveling button 35. When the removal-by-self-traveling button 35 has been operated, the processor 21 may assume that the driver has selected the maintenance by self-traveling, and cause the flow to proceed to step ST8. When the removal-by-dealer button 34 has been operated, the processor 21 may cause the flow to proceed to step ST4. The processor 21 may display the information regarding dealers who are able to replace the catalyst device. In this case, the removal by a dealer is not a process of replacing the catalyst device, but a process of burning out the PM accumulating in the catalyst device. The dealer is able to effectively burn off the PM accumulating in the catalyst device and refresh the catalyst device by a dedicated process in accordance with the automobile 1. It is to be noted that the dealer is able to burn off the PM accumulating in the catalyst device by a predetermined way of traveling.

In step ST8, the processor 21 may set the removal flag 26 in the memory 20. The removal flag 26 in the memory 20 may be an initial value for a reset. The removal flag 26 is used, in the output control described later, to switch between the normal, performance-prioritized output control and the output control for removal. The normal, performance-prioritized output control includes allowing the engine 3 to exhibit its normal performance. The output control for removal includes giving priority to the removal. When the removal flag 26 is set, the processor 21 may give priority to the output control for removal over the normal output control. When the removal flag 26 is reset, the processor 21 may carry out the normal output control and refrain from carrying out the output control for removal.

The use of the removal flag 26 saves the processor 21 from starting the output control for removal at timing when the processor 21 determines that the maintenance of the catalyst device by self-traveling is to be carried out. The travel environment of the vehicle at the timing when the processor 21 determines that the maintenance of the catalyst device by self-traveling is to be carried out is not necessarily suited to the output control for removal. For example, when the vehicle is parked or stopped while traveling, or when the vehicle is caught in a traffic jam, it is difficult for the automobile 1 to continuously control the engine 3 to a lean state to obtain an exhaust gas temperature high enough to burn out PM. The use of the removal flag 26 makes it possible for the processor 21 to carry out the output control for removal by the maintenance by self-traveling in the travel environment suited to the maintenance of the catalyst device by self-traveling.

Thus, in a first display process in step ST6, when the removal to improve the accumulation state by self-traveling by the driver themselves is selected, the processor 21 may carry out the output control for removal to improve the accumulation state of the exhaust-containing substance in the catalyst device.

Moreover, on the meter panel 18, the first screen in step ST6 may be displayed at least once before the second screen in step ST3 is displayed.

In step ST9, the processor 21 may provide route guidance that makes it possible to carry out the maintenance of the catalyst device while traveling.

For example, the processor 21 may search the map data 27 held in the memory 20 for, for example, a road segment of an expressway suited to carrying out the output control for removal near the current position by the GNSS receiver 16. Moreover, the processor 21 may search for a route to the road segment, and display the route on the meter panel 18. The road segment to be searched here may have a length that make it possible to ensure a travel speed high enough to burn out PM, and have a travel distance long enough to burn out PM.

Thereafter, the processor 21 may end the control.

In one alternative, after the process of step ST8, the processor 21 may end the control without carrying out step ST9. In this case, based on the removal flag 26 already set in the memory 20, the processor 21 may carry out, on subsequent travel, the output control that gives priority to the output control for removal.

Moreover, when an expressway is included in the route searched for prior to the process of step ST9, the processor 21 may display the route as it is on the meter panel 18.

As described, the processor 21 may separately determine whether or not the accumulation state is improvable by the removal while traveling by the driver themselves, and whether or not the accumulation state is unimprovable by the removal while traveling by the driver themselves, based on the detection results of the differential pressure sensors 10 to 12.

When the accumulation state is improvable by the removal while traveling by the driver themselves, the processor 21 may display improvability by the removal while traveling by the driver themselves, on the meter panel 18, by the first display process in step ST6. Moreover, on the meter panel 18, the necessity of the removal may be displayed as the display of the accumulation state of the exhaust-containing substance in the catalyst device. Here, the improvability by the removal while traveling by the driver themselves, and the removal by the maintenance company instead of the driver may be displayed on the meter panel 18 as choices of the removal to be selected by the driver.

Moreover, when the accumulation state is unimprovable by the removal while traveling by the driver themselves, the processor 21 may display the necessity of the replacement by the dealer as the maintenance company, on the meter panel 18, by the second display process in step ST3.

When the exhaust-containing substance that is removable by self-traveling has accumulated in the catalyst device, the processor 21 may determine the presence of the state based on the detection results of the differential pressure sensors 10 to 12 and offer the driver a proposal for the removal of the exhaust-containing substance by self-traveling.

Furthermore, when the driver selects the removal of the exhaust-containing substance by self-traveling, the processor 21 may set the removal flag 26 held in the memory 20, to carry out the output control for removal to remove the exhaust-containing substance on the subsequent travel.

Figure 7:
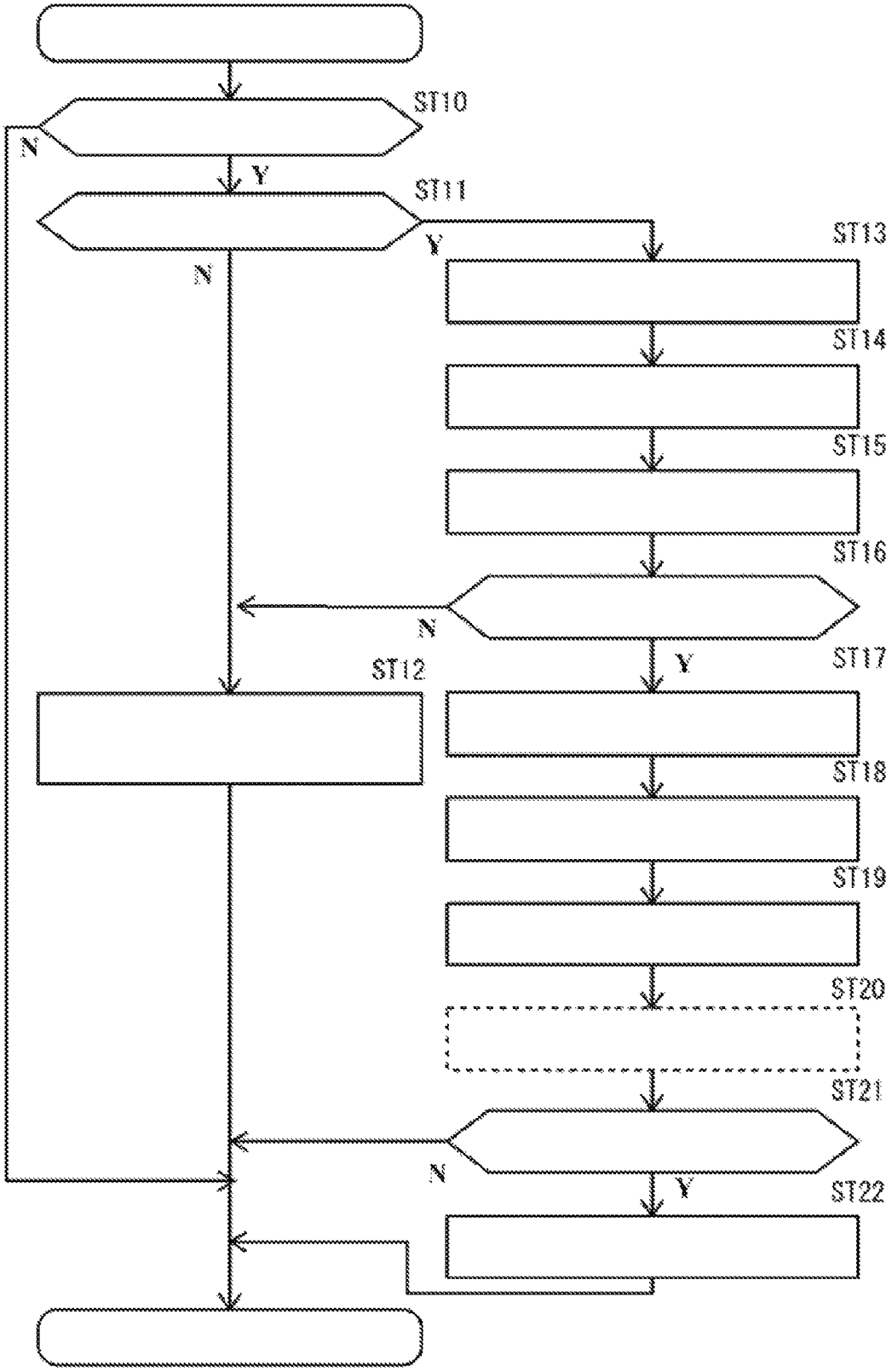
FIG. 7 is a flowchart of an output control to cope with removal by self-traveling, by the processor in FIG. 1.

FIG. 7 is a flowchart of the output control to cope with the removal by self-traveling. The output control is to be carried by the processor 21 in FIG. 1.

The processor 21 may repeatedly carry out the output control in FIG. 7 when the automobile 1 travels.

In step ST10, the processor 21 may determine whether or not the automobile 1 is traveling. In this determination, the term "traveling" may refer to not only a case where the automobile 1 is actually traveling, but also a case where the automobile 1 is parked or stopped for traveling. The processor 21 may determine whether or not the automobile 1 is traveling based on, for example, whether the engine 3 is in operation, or whether an unillustrated ignition switch to bring the engine 3 into operation is switched on. When the automobile 1 is not traveling, the processor 21 may end the control without carrying out the output control. When the automobile 1 is traveling, the processor 21 may cause the flow to proceed to step ST11.

It is to be noted that the ignition switch being switched on may cause the processor 21 to start the output control in FIG. 7. In this case, for example, the processor 21 may repeatedly carry out the output control in FIG. 7 until the ignition switch is switched off. This makes it possible to ensure that the processor 21 carries out the output control in FIG. 7 solely when the automobile 1 is traveling.

In step ST11, the processor 21 may acquire a value of the removal flag 26 held in the memory 20, to determine whether or not the removal flag 26 is set. When the removal flag 26 is set, the processor 21 may cause the flow to proceed to step ST13 to preferentially carry out the output control for removal to travel while removing PM, etc. When the removal flag 26 is not set but reset, the processor 21 may cause the flow to proceed to step ST12 for the normal output control.

In step ST12, the processor 21 may carry out the normal output control.

Here, the normal output control may include, for example, supplying gasoline richly to the engine 3 of the automobile 1 to make use of the travel performance of the automobile 1, while causing the lean combustion in the engine 3 when suppression of an amount of use of gasoline hardly affects the travel performance.

In contrast, the output control for removal may include, for example, continuing the lean combustion in the engine 3 except in emergency. In the lean combustion, the exhaust gas temperature from the engine 3 becomes higher, making it easier to burn off the PM, etc. accumulating in the catalyst device, as compared with gasoline-rich combustion.

For example, while traveling accompanied by large acceleration, e.g., when starting after waiting for a traffic signal to change, the lean combustion in the engine 3 impairs the feeling of acceleration of the automobile 1. Accordingly, in one example, when the maintenance of the catalyst device is unnecessary, the processor 21 may carry out the normal output control.

As described, in the normal output control, with respect to gasoline supply to the engine 3, the processor 21 may give priority to a rich state over the lean state to exhibit the performance of the engine 3.

Thereafter, the processor 21 may end the control.

In step ST13, the processor 21 may start the output control for removal.

In the output control for removal, for example, with respect to the gasoline supply to the engine 3, the processor 21 may give priority to the lean state over the rich state. When the gasoline supplied to the engine 3 of the automobile 1 is in the lean state, the exhaust gas temperature from the engine 3 becomes high. This causes PM and sulfur compounds accumulating in the catalyst device to be exposed continuously or intermittently to the hot exhaust gas, and burned off and removed from the catalyst device.

It is to be noted that the processor 21 may also cause, if necessary, the combustion in the engine 3 in the rich state in the output control for removal. It suffices that, in the output control for removal, with respect to the gasoline supply to the engine 3, the processor 21 gives priority to the lean state over the rich state.

In step ST14, the processor 21 may acquire data regarding the surroundings of the vehicle, to determine whether or not the current travel environment is suited to carrying out the output control for removal. The automobile 1 may include the vehicle external camera 13 and the Lidar 14. The processor 21 may acquire the captured images and the space data regarding the current surroundings from the vehicle external camera 13 and the Lidar 14 as the vehicle outside sensors. Based on the data acquired from the vehicle external camera 13 and the Lidar 14 as the vehicle outside sensors, the processor 21 may acquire data regarding other vehicles, e.g., preceding vehicles and following vehicles, and data regarding a road category of a road on which the vehicle is traveling, e.g., an expressway and a general road. Moreover, based on the data acquired from the vehicle external camera 13 and the Lidar 14 as the vehicle outside sensors, the processor 21 may also acquire sign data regarding, for example, a lighting state of a traffic light installed on the road, and a stop line.

In step ST15, the processor 21 may determine the current travel environment based on the acquired data regarding the surroundings of the vehicle.

For example, the processor 21 may determine whether or not the automobile 1 is traveling at a high speed on an expressway without traffic congestion.

For example, the processor 21 may determine whether or not the automobile 1 is going to start, on a general road, from stoppage to wait for a traffic signal to change.

In step ST16, the processor 21 may determine whether or not the current travel environment is suited to carrying out the output control for removal.

For example, when it is determined that the current traveling environment is that the automobile 1 is traveling at a high speed on an expressway without traffic congestion, the processor 21 may determine that the current travel environment is suited to carrying out the output control for removal.

For example, when it is determined that the current travel environment is that the automobile 1 is traveling on an expressway but is traveling at a low speed or stopped in a traffic jam, the processor 21 may determine that the current travel environment is not suited to carrying out the output control for removal.

For example, when the automobile 1 is going to start, on the general road, from the stoppage to wait for the traffic signal to change, the processor 21 may determine that the current travel environment is suited to carrying out the output control for removal.

For example, when the automobile 1 is traveling at a low speed on the general road or stopped in a traffic jam, the processor 21 may determine that the current travel environment is not suited to carrying out the output control for removal.

The determination in step ST15 is described in detail with reference to FIG. 9 described later.

Thus, the processor 21 may determine whether or not the current travel environment is suited to carrying out the output control for removal, based on the detection results of the surroundings of the automobile 1 by vehicle external camera 13 and the Lidar 14 as the vehicle outside sensors.

When the current travel environment is suited to carrying out the output control for removal, the processor 21 may cause the flow to proceed to step ST17.

When the current travel environment is not suited to carrying out the output control for removal, the processor 21 may cause the flow to proceed to step ST12. In this case, the processor 21 may carry out the normal output control even though the removal flag 26 is set. The processor 21 may refrain from carrying out the output control for removal suitable for the removal of PM or sulfur compounds from the catalyst device. The processor 21 may stop carrying out the output control for removal until the travel environment becomes suited to carrying out the output control for removal.

In step ST17, the processor 21 may carry out the output control for removal. The processor 21 may carry out the output control that gives priority to the lean combustion.

As described, the processor 21 is configured to carry out the output control for removal to improve the accumulation state of the exhaust-containing substance in the catalyst device, while the automobile 1 is traveling, when the processor 21 determines that the travel environment is suited to carrying out the output control for removal.

This leads to easier removal of PM, sulfur compounds, etc. from the catalyst device.

In step ST18, the processor 21 may acquire, from the differential pressure sensors 10 to 12, the detection results while the output control for removal is being carried out.

In step ST19, the processor 21 may display, on the meter panel 18, the acquired detection results while the output control for removal is being carried out. This makes it possible for the driver to easily visually confirm, while traveling, that the output control for removal is being carried out, and changes in the accumulation state in the catalyst device by the removal.

Figure 8:
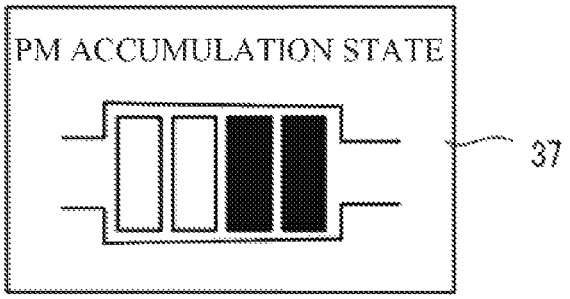
FIG. 8 illustrates an example of a PM accumulation state display screen, to be displayed on the meter panel in FIG. 1, in processing in FIG. 7.

FIG. 8 illustrates an example of a PM accumulation state display screen 37 to be displayed on the meter panel 18 in FIG. 1, in the processing in FIG. 7. The processor 21 may display the PM accumulation state display screen 37 on the meter panel 18 during the output control for removal. The PM accumulation state display screen 37 in FIG. 8 may display, by a level indicator, the accumulation state in the catalyst device during the removal. FIG. 8 illustrates an example where PM has accumulated in the catalyst device in about half of capacity of the catalyst device.

As described, the processor 21 may display, on the meter panel 18, the accumulation state of the exhaust-containing substance in the catalyst device, based on the detection results of the differential pressure sensors 10 to 12 when carrying out the output control for removal to improve the accumulation state of the exhaust-containing substance in the catalyst device. This makes it possible for the driver of the automobile 1 to grasp detailed progress of improvement of the catalyst device. Moreover, it is possible for the driver to grasp, based on the display, that the normal output control has been switched to the output control for removal to improve the accumulation state of the exhaust-containing substance in the catalyst device. It is also possible to grasp, for example, timing of return to the original normal output control, based on the display. It is possible for the driver to grasp the travel state of the automobile 1.

In step ST20, the processor 21 may instruct the driver to make a variable operation of an accelerator, as needed, while the output control for removal is being carried out. Making the operation to open or close the accelerator causes a considerable change in pressure of the exhaust gas. This may cause easy removal of the accumulating PM from the catalyst device. The process of step ST20 is not essential for carrying out the output control for removal.

In step ST21, the processor 21 may determine whether or not to end the output control for removal.

When the PM accumulating in the catalyst device has been substantially completely removed from the catalyst device by the removal, no further output control for removal needs to be performed.

Moreover, there is possibility that, even if the output control for removal is carried out for a while, the PM accumulation state in the catalyst device is not improved satisfactorily. In this case, even if the output control for removal is continuously carried out, there is high possibility that a good removal effect is not obtained. If the PM accumulating in the catalyst device is fully solidified, it is difficult to remove it.

When the processor 21 determines that the output control for removal is to be ended, the processor 21 may cause the flow to proceed to step ST22.

When the processor 21 determines that the output control for removal is not to be ended but to be continued, the processor 21 may end the control without causing the flow to proceed to step ST22.

In step ST22, the processor 21 may reset the removal flag 26 in the memory 20 to end the output control for removal. Thereafter, the processor 21 may end the control.

As described, the processor 21 is configured to control whether to start to carry out the output control for removal, or whether to continue to carry out the output control for removal, based on the setting of the removal flag 26 in the memory 20.

Moreover, the processor 21 is configured to carry out the output control for removal when the current travel environment is suited to carrying out the output control for removal.

Furthermore, while the output control for removal is being carried out, the processor 21 is able to display the state of the PM removal from the catalyst device by the output control for removal, on a display device such as the meter panel 18.

Figure 9:
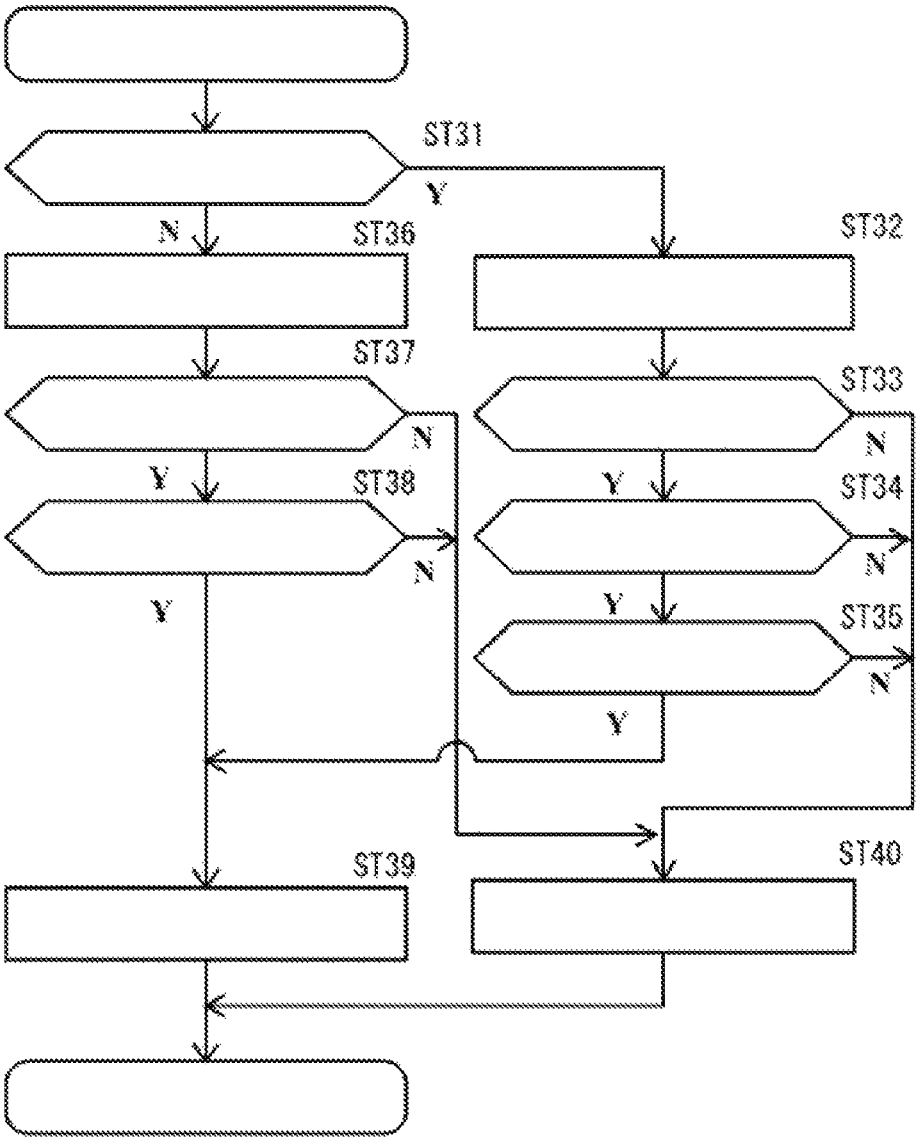
FIG. 9 is an example of a detailed flowchart of a travel environment determination as to the automobile, in the output control in FIG. 7.

FIG. 9 is an example of a detailed flowchart of a travel environment determination as to the automobile 1, in the output control in FIG. 7.

The processor 21 may make the travel environment determination in FIG. 9, in step ST15 in FIG. 7.

By the travel environment determination in FIG. 9, the processor 21 may determine, in step ST39, that the travel environment is suited to carrying out the output control for removal, or alternatively, the processor 21 may determine, in step ST40, that the travel environment is not suited to carrying out the output control for removal.

Thus, in step ST16 in FIG. 7, the processor 21 may determine, based on a result of the travel environment determination in FIG. 9, whether or not the current travel environment is suited to carrying out the output control for removal.

In step ST31, the processor 21 may determine whether or not the automobile 1 is traveling on an expressway. At this occasion, the processor 21 may make the determination based on the detection data by the vehicle external camera 13 and the Lidar 14 as the vehicle outside sensors, or may make the determination based on the latest position and the map data 27. The latest position is generated by the GNSS receiver 16. The road on which the automobile 1 generally travels may be classified into an expressway and a general road. An expressway is infrastructure developed to allow the automobile 1 to travel at a higher speed than on a general road. The engine 3 of the automobile 1 on high-speed travel is able to easily keep higher rotation speed than on low-speed travel. Bringing the engine 3 on such travel into the lean state allows the exhaust gas temperature to become high and easily stabilized. The exhaust-containing substance such as PM accumulating in the catalyst device continues to be calcined at a high temperature, and easily separated and discharged from the catalyst device.

When the processor 21 determines that the automobile 1 is traveling on an expressway, the processor 21 may cause the flow to proceed to step ST32.

When the processor 21 does not determine that the automobile 1 is traveling on an expressway, the processor 21 may cause the flow to proceed to step ST36.

In step ST32, the processor 21 may fix a determination that the automobile 1 is traveling on an expressway.

In step ST33, the processor 21 may determine whether or not the travel state of the automobile 1 is stable at a high speed. When traveling on a straight expressway, the travel of the automobile 1 is easily stable at a high speed. A speed to be determined to be a high speed may be, for example, 60 km/h or 70 km/h. To be stable at a high speed refers to, for example, a period of time until the exhaust-containing substance accumulating in the catalyst device, e.g., PM, starts to be partially burned out.

When the automobile 1 is in the travel state in which the automobile 1 is stable at a high speed, the processor 21 may cause the flow to proceed to step ST34.

When the automobile 1 is not in the travel state in which the automobile 1 is stable at a high speed, the processor 21 may cause the flow to proceed to step ST40.

In step ST34, the processor 21 may determine, with respect to the travel state of the automobile 1, whether or not an inter-vehicle distance from the automobile 1 to a preceding vehicle is equal to or greater than a threshold value, i.e., an inter-vehicle distance threshold value. When the output control of the automobile 1 is changed from the normal output control to the output control for removal, the performance of the automobile 1 may possibly decline. Accordingly, when the automobile 1 starts traveling by the output control for removal, it is desirable that a sufficient inter-vehicle distance from the vehicle to the preceding vehicle be provided. The inter-vehicle distance threshold value to be used here may be, for example, an inter-vehicle distance recommended to be provided in accordance with the vehicle speed.

When the inter-vehicle distance to the preceding vehicle is equal to or greater than the inter-vehicle distance threshold value, the processor 21 may cause the flow to proceed to step ST35.

When the inter-vehicle distance to the preceding vehicle is not equal to or greater than the inter-vehicle distance threshold value, the processor 21 may cause the flow to proceed to step ST40.

In step ST35, the processor 21 may determine, with respect to the travel state of the automobile 1, whether or not an inter-vehicle distance from the automobile 1 to a following vehicle is equal to or greater than a threshold value, i.e., an inter-vehicle distance threshold value. When the automobile 1 starts to travel by the output control for removal, the automobile 1 may possibly exhibit different behavior from behavior the automobile 1 has exhibited during the normal output control. A driver of the following vehicle needs to deal with the change. Accordingly, when the automobile 1 starts traveling by the output control for removal, it is desirable that a sufficient inter-vehicle distance from the vehicle to the following vehicle be provided. The inter-vehicle distance threshold value to be used here may be, for example, an inter-vehicle distance recommended to be provided in accordance with the vehicle speed.

When the inter-vehicle distance to the following vehicle is equal to or greater than the inter-vehicle distance threshold value, the processor 21 may cause the flow to proceed to step ST39.

When the inter-vehicle distance to the following vehicle is not equal to or greater than the inter-vehicle distance threshold value, the processor 21 may cause the flow to proceed to step ST40.

In step ST36, the processor 21 may fix a determination that the automobile 1 is traveling not on an expressway but on a general road.

On a general road, disturbances occur more easily than on an expressway, and the travel on a general road is less stable than the travel on an expressway.

However, some drivers rarely travel on an expressway. Accordingly, in this embodiment, the automobile 1 is configured to carry out, even intermittently, the output control for removal while traveling on a general road. Thus, the output control for removal is expected to produce higher effects of the removal of the exhaust-containing substance such as PM from the catalyst device than in a case where the output control for removal is carried out solely on an expressway.

In step ST37, the processor 21 may determine whether or not the vehicle is about to start from the stoppage. While traveling, the automobile 1 stops at a stop signal or at a stop line that indicates a stop, and thereafter, the automobile 1 starts and continues traveling. Using the output control for removal when starting from the stoppage may cause the automobile 1 to become slower in acceleration. This results in possibility that the driver further operates the accelerator to accelerate the automobile 1 as desired. In a period of time until the vehicle speed reaches a limit speed, the exhaust gas temperature from the engine 3 is expected to become higher.

When the vehicle is about to start from the stoppage, the processor 21 may cause the flow to proceed to step ST38.

When the vehicle is not about to start from the stoppage, the processor 21 may cause the flow to proceed to step ST40.

In step ST38, the processor 21 may check safety in the rear of the vehicle as the travel state of the automobile 1. If the following vehicle is starting to move with the short inter-vehicle distance, changing the output control of the automobile 1 from the normal output control to the output control for removal may possibly cause a situation due to a decline in the travel performance of the automobile 1.

When the rear of the vehicle is safe, the processor 21 may cause the flow to proceed to step ST39.

When the rear of the vehicle is not safe, the processor 21 may cause the flow to proceed to step ST40.

It is to be noted that the processor 21 may check safety not only in the rear of the vehicle but also in front of the vehicle as the travel state of the automobile 1.

In step ST39, the processor 21 may fix a determination that the current travel environment of the vehicle is suited to carrying out the output control for removal. Thereafter, the processor 21 may end the control.

In step ST40, the processor 21 may fix a determination that the current travel environment of the vehicle is not suited to carrying out the output control for removal. Thereafter, the processor 21 may end the control.

Thus, when the processor 21 determines that the automobile 1 is traveling on an expressway in predetermined travel environment that is suited to carrying out the removal, the processor 21 may carry out the output control for removal, on the high-speed travel. The output control for removal includes bringing the engine 3 into a lean combustion state to raise the exhaust gas temperature. In this case, the output control for removal is expected to be carried out continuously and effectively on the expressway.

When the processor 21 determines that the automobile 1 is traveling on a general road in predetermined travel environment that is suited to carrying out the removal, the processor 21 may carry out a general-road output control. The general-road output control includes bringing the engine 3 into the lean combustion state to raise the exhaust gas temperature when starting from the stoppage. In this case, the output control for removal is expected to be carried out intermittently.

Figure 10:
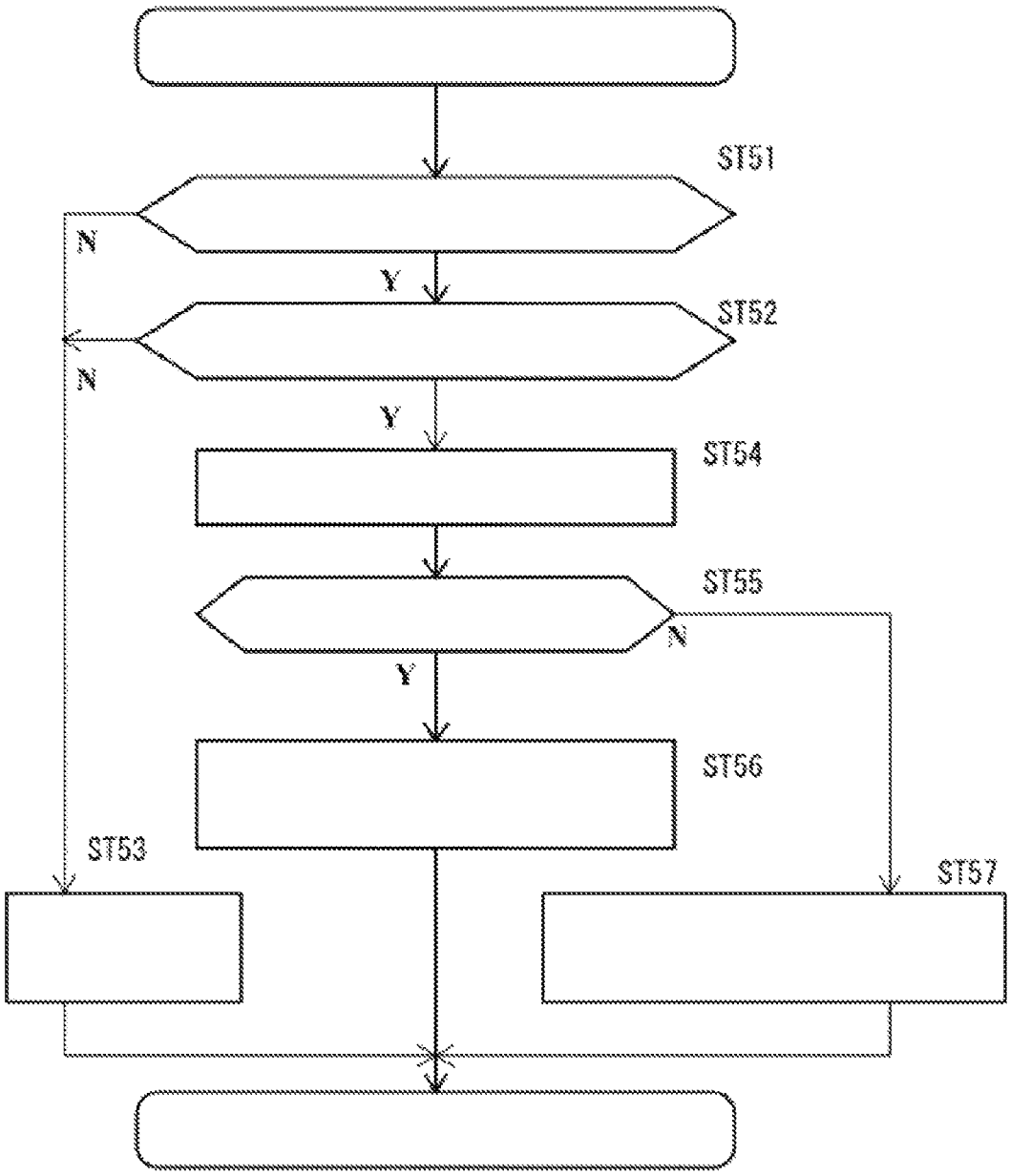
FIG. 10 is an example of a detailed flowchart of an end determination of a PM removal control, in the output control in FIG. 7.

FIG. 10 is an example of a detailed flowchart of an end determination of the PM removal control, in the output control in FIG. 7.

FIG. 10 is, for example, a flowchart of the end determination of the removal control in an example suitable for the removal of PM accumulating in the catalyst device while traveling on an expressway.

The processor 21 may make, for example, the end determination in FIG. 10, in step ST21 in FIG. 7.

In step ST51, the processor 21 may acquire the latest speed detected by the vehicle speed sensor, and determine whether or not the current speed of the vehicle is kept at 60 km/h or higher.

Other examples of the threshold speed to determine the speed may include 70 km/h.

When the current speed of the vehicle is kept at 60 km/h or higher, the processor 21 may cause the flow to proceed to step ST52.

When the current speed of the vehicle is not kept at 60 km/h or higher, the processor 21 may cause the flow to proceed to step ST53.

In step ST52, the processor 21 may determine whether or not a time duration of the removal since the start of the output control for removal has reached 30 minutes. The processor 21 may acquire current data regarding the time duration of the removal, to determine whether or not the time duration of the removal has reached 30 minutes. The processor 21 instructs the timer 17 to measure the time duration of the removal at the start of the output control for removal.

Other examples of a threshold value to determine the time duration may include 40 minutes.

When the time duration of the removal has reached 30 minutes, the processor 21 may cause the flow to proceed to step ST54.

When the time duration of the removal has not reached 30 minutes, the processor 21 may cause the flow to proceed to step ST53.

In step ST53, the processor 21 may fix a determination that the PM removal control has not ended. Thereafter, the processor 21 may end the control.

In this case, in the process of step ST21 in FIG. 7, the processor 21 may determine that the removal control is not to be ended, and continue the output control for removal.

In step ST54, the processor 21 may acquire the detection results of the differential pressure sensors 10 to 12.

In step ST55, the processor 21 may determine whether or not the detection values of the differential pressure sensors 10 to 12 have been improved to a removal threshold value or smaller. Here, the removal threshold value may be basically a value smaller than the alarm threshold value. In one example, the removal threshold value may be the detection values of the differential pressure sensors 10 to 12 in a state where little exhaust-containing substance has accumulated in the catalyst device.

When the detection values of the differential pressure sensors 10 to 12 are equal to or smaller than the removal threshold value, the processor 21 may cause the flow to proceed to step ST56.

When the detection values of the differential pressure sensors 10 to 12 are not equal to or smaller than the removal threshold value, the processor 21 may cause the flow to proceed to step ST57.

In step ST56, the processor 21 may determine that exhaust-containing substance has been effectively removed by the PM removal control by self-traveling, and fix a determination that the control has ended successfully.

Moreover, the processor 21 may display, on the meter panel 18, that the control has ended successfully. Thereafter, the processor 21 may end the control.

In this case, in the process of step ST21 in FIG. 7, the processor 21 may determine that the removal control is to be ended, and refrain from carrying out the output control for removal after that.

Figure 11:
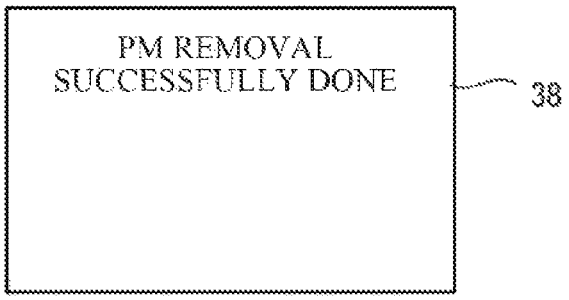
FIG. 11 is an example of a PM removal success notification screen, to be displayed on the meter panel in FIG. 1, in processing in FIG. 10.

FIG. 11 illustrates an example of a PM removal success notification screen 38 to be displayed on the meter panel 18 in FIG. 1, in the processing in FIG. 10.

In the PM removal success notification screen 38 in FIG. 11, a message is displayed that notifies that the exhaust-containing substance has been effectively removed by the PM removal control by self-traveling, and that the PM removal control has been successful. This makes it possible for the driver to recognize a result of the removal by the PM removal control by self-traveling.

In step ST57, the processor 21 may determine that the exhaust-containing substance has not been effectively removed by the PM removal control by self-traveling, and fix a determination that the control has ended unsuccessfully.

Moreover, the processor 21 may display, on the meter panel 18, that the control has ended unsuccessfully.

Furthermore, the processor 21 may display the dealer information on the meter panel 18. Thereafter, the processor 21 may end the control.

In this case, in the process of step ST21 in FIG. 7, the processor 21 may determine that the removal control is to be ended, and refrain from carrying out the output control for removal after that.

Figure 12:
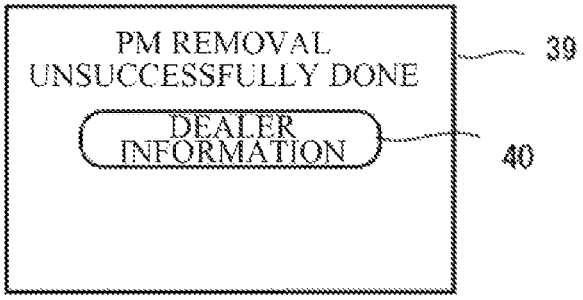
FIG. 12 is an example of a PM removal unsuccess notification screen, to be displayed on the meter panel in FIG. 1, in the processing in FIG. 10.

FIG. 12 is an example of a PM removal unsuccess notification screen 39 to be displayed on the meter panel 18 in FIG. 1, in the processing in FIG. 10.

In the PM removal unsuccess notification screen 39 in FIG. 12, a message is displayed that notifies that the exhaust-containing substance has not been effectively removed by the PM removal control by self-traveling, and that the PM removal control has been unsuccessful. This makes it possible for the driver to recognize that exhaust-containing substance accumulating in the catalyst device, e.g., PM, has not been sufficiently removed by the PM removal control by self-traveling.

Moreover, in the PM removal unsuccess notification screen 39 in FIG. 12, a dealer information button 40 may be displayed. The dealer information button 40 is operable by the driver. This makes it possible for the driver to recognize that further removal for the catalyst device is necessary.

As described, the end determination of the PM removal control in FIG. 10 may include determining whether or not the time duration of the lean combustion in the engine 3 is equal to or longer than at least the time threshold value while the automobile 1 is traveling at a speed equal to or higher than the speed threshold value. In this case, the output control for removal to improve the accumulation state of the exhaust-containing substance in the catalyst device is continuously or intermittently carried out until the condition of the end determination is satisfied.

Moreover, after the output control for removal is carried out at least once, the processor 21 may determine whether or not the accumulation state of the exhaust-containing substance in the catalyst device has been improved based on the detection results of the differential pressure sensors 10 to 12. When the accumulation state of the exhaust-containing substance in the catalyst device has not been improved, the processor 21 may stop the output control for removal to improve the accumulation state of the exhaust-containing substance in the catalyst device, and display a third screen on the meter panel 18. The third screen includes a notification of the removal by a dealer as a maintenance company. The third screen does not include the removal by the driver themselves while traveling.

Figure 13:
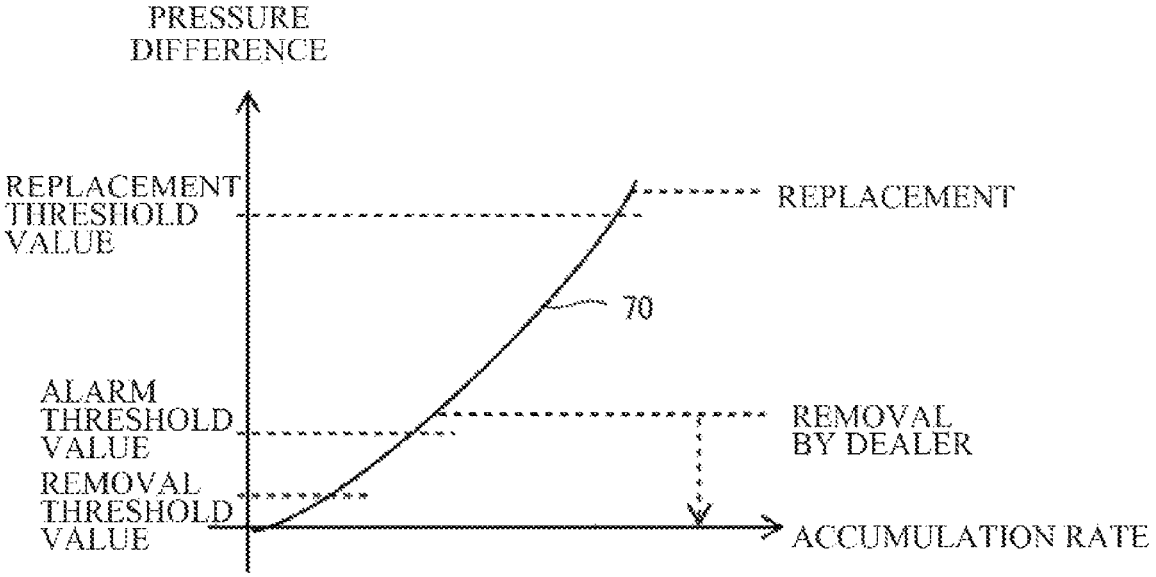
FIG. 13 illustrates an example of relation between a PM accumulation rate in the PM catalyst device and pressure differences to be detected by differential pressure sensors.

FIG. 13 illustrates an example of relation between a PM accumulation rate in the PM catalyst device and the pressure differences to be detected by the differential pressure sensors 10 to 12.

The three-way catalyst device 5 may serve as the PM catalyst device.

The horizontal axis in FIG. 13 denotes the PM accumulation rate in the PM catalyst device. The vertical axis in FIG. 13 denotes the pressure differences to be detected by the differential pressure sensors 10 to 12.

FIG. 13 illustrates a characteristic curve 70 of the PM catalyst device. This characteristic curve 70 is an example.

The pressure differences to be detected by the differential pressure sensors 10 to 12 increase as an amount of PM accumulating in the PM catalyst device increases and the accumulation rate increases. When the accumulation rate in the PM catalyst device is approximately 1, the PM catalyst device needs to be replaced.

In the PM catalyst device having such a characteristic, as illustrated in the figure, the replacement threshold value, the alarm threshold value, and the removal threshold value may be set.

The replacement threshold value may be set to a slightly smaller value than the pressure difference when the PM catalyst device is to be replaced.

The alarm threshold value basically suffices to be smaller than the replacement threshold value. In one example, the alarm threshold value may be smaller than the pressure difference when expert removal by a dealer is to be performed. This makes it possible, immediately after the alarm, for the dealer to remove PM from the PM catalyst device by the expert removal, without replacing the catalyst device. Moreover, the alarm threshold value suffices to be greater than the pressure difference in a new PM catalyst device where no PM has accumulated.

The alarm threshold value may be set to any value between a pressure difference that the dealer is able to deal with and the pressure difference in the new PM catalyst device. Lowering the alarm threshold value causes an increase in the number of times the alarm is given and the number of times the removal by self-traveling is carried out, but makes it possible to keep the PM catalyst device in a relatively clean state. Raising the alarm threshold value makes it possible to reduce the number of times the alarm is given and the number of times the removal by self-traveling is carried out.

The removal threshold value suffices to be smaller than the alarm threshold value. Moreover, the removal threshold value suffices to be greater than the pressure difference in the new PM catalyst device where no PM has accumulated.

Setting the removal threshold value to a small value makes it possible to restore the PM catalyst device to the relatively clean state. Moreover, it is possible to lengthen a period of time until the removal becomes necessary again after the restoration. Raising the removal threshold value is expected to lead to an increase in the number of times the removal by self-traveling ends successfully.

As described, in this embodiment, the accumulation state of the exhaust-containing substance in the catalyst device to be used in the exhaust system 4 of the engine 3 of the automobile 1 is detected with the differential pressure sensors 10 to 12. In accordance with the detection results of the differential pressure sensors 10 to 12, the processor 21 determines the accumulation state of the exhaust-containing substance in the catalyst device. Hence, in this embodiment, it is possible to manage the accumulation state of the exhaust-containing substance in the catalyst device of the exhaust system 4 of the automobile 1.

In particular, in this embodiment, in accordance with the determination result of the accumulation state of the exhaust-containing substance in the catalyst device, the output control for removal is carried out to improve the accumulation state of the exhaust-containing substance in the catalyst device, while the automobile 1 is traveling after the determination. Hence, it is possible to improve the accumulation state of the exhaust-containing substance in the catalyst device of the automobile 1, by the traveling of the automobile 1. In the catalyst device of the automobile 1, the exhaust-containing substance such as nitrogen oxides, soot, or sulfur compounds contained in the exhaust gas is hindered to accumulate in a large amount. In direct injection gasoline engines configured to cause the lean combustion, such exhaust-containing substance tends to increase, as compared with the engine 3 devoid of the lean combustion or the engine 3 devoid of direct gasoline injection. Using this embodiment hinders the accumulation of the exhaust-containing substance even in the catalyst device to be used in the exhaust system 4 of the direct injection gasoline engine configured to cause the lean combustion.

Moreover, in this embodiment, the automobile 1 includes the vehicle external camera 13 and the Lidar 14 as the vehicle outside sensors configured to detect the surroundings of the automobile 1. Based on the detection result of the surroundings of the automobile 1 by the vehicle external camera 13 and the Lidar 14 as the vehicle outside sensors, the processor 21 determines whether or not the travel environment is suited to carrying out the output control for removal. When the processor 21 determines that the travel environment is suited to carrying out the output control for removal, the processor 21 carries out the output control for removal to improve the accumulation state of the exhaust-containing substance in the catalyst device. Hence, it is possible for the processor 21 of the automobile 1 to carry out the output control for removal while the automobile 1 is traveling, when the processor 21 determines that the travel environment is suited to carrying out the output control for removal. This saves the driver from determining by themselves whether or not the current travel environment is suited to carrying out the output control for removal. Moreover, it is possible to carry out the output control for removal, when the travel environment in which the automobile 1 is traveling is safe. This leads to reduction in the burden on the driver.

In this embodiment, the processor 21 may determine whether or not the automobile 1 is traveling on an expressway. When the automobile 1 is traveling on an expressway, the processor 21 may continuously carry out an expressway output control. The expressway output control includes bringing the engine 3 into the lean combustion state to raise the exhaust gas temperature while the automobile 1 is traveling at a high speed. Hence, in this embodiment, it is possible to carry out the output control for removal suitable for the travel environment of the automobile 1 while the automobile 1 is traveling on an expressway. This leads to efficient removal of nitrogen oxides and soot, or sulfur compounds accumulating in the catalyst device, from the catalyst device.

Moreover, the processor 21 may determine whether or not the automobile 1 is traveling on a general road. When the automobile 1 is traveling on a general road, the processor 21 may repeatedly carry out the general-road output control. The general-road output control includes bringing the engine 3 into the lean combustion state to raise the exhaust gas temperature when starting from the stoppage. Hence, in this embodiment, it is possible to carry out the output control for removal suitable for the travel environment of the automobile 1 while the automobile 1 is traveling on a general road. This results in the removal of nitrogen oxides and soot, or sulfur compounds accumulating in the catalyst device, from the catalyst device.

Second Embodiment

Description is given next of an exhaust catalyst management apparatus to be applied to the automobile 1 according to a second embodiment of the disclosure. In the following description, differences from the forgoing embodiment are mainly described. Description of configurations and processing similar to those of the forgoing embodiment is omitted.

The forgoing embodiment is an example of the removal of mainly PM out of the exhaust-containing substances that may possibly accumulate in the catalyst device.

In this embodiment, description is given of an example of the removal of mainly sulfur compounds out of the exhaust-containing substances that may possibly accumulate in the catalyst device.

In this case, a control to be carried out by the processor 21 may be basically similar to that of the forgoing embodiment.

However, in one example, at least a part of the display on the meter panel 18 and the end determination of the removal control may be changed from the forgoing embodiment.

When solely sulfur compounds are to be removed, the process of step ST21 in FIG. 7 may be omitted.

Figure 14:
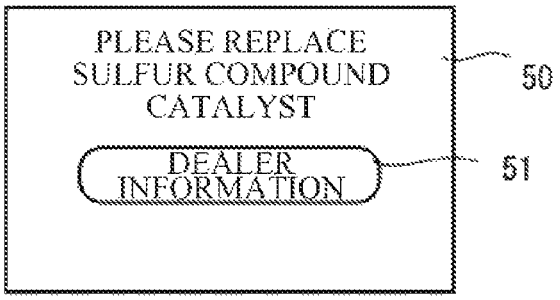
FIG. 14 illustrates an example of a replacement notification screen of a catalyst device for sulfur compounds, to be displayed on the meter panel in FIG. 1, by the processing in FIG. 2 according to a second embodiment of the disclosure.

FIG. 14 is an example of a replacement notification screen 50 of a catalyst device for sulfur compounds. The replacement notification screen 50 is to be displayed on the meter panel 18 in FIG. 1, by the processing in FIG. 2 in the second embodiment of the disclosure.

In the process of step ST3 in FIG. 2, the processor 21 may generate the replacement notification screen 50 and display the replacement notification screen 50 on the meter panel 18. The replacement notification screen 50 notifies that the replacement of the catalyst device for sulfur compounds in FIG. 14 is necessary.

On the replacement notification screen 50 of the catalyst device for sulfur compounds in FIG. 14, a dealer information button 51 may be displayed together with a message that notifies the driver of the replacement of the catalyst device for sulfur compounds. The dealer information button 51 is operable by the driver. This makes it possible for the driver to recognize, while traveling or when on board the automobile 1, that the replacement of the catalyst device for sulfur compounds is necessary.

Figure 15:
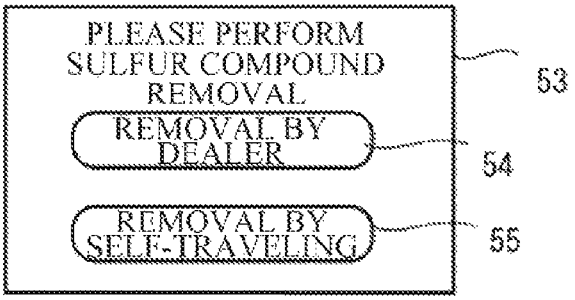
FIG. 15 illustrates an example of an alarm notification screen of removal of sulfur compounds, to be displayed on the meter panel in FIG. 1, by the processing in FIG. 2 according to the second embodiment of the disclosure.

FIG. 15 is an example of an alarm notification screen 53 of the removal of sulfur compounds. The alarm notification screen 53 is to be displayed on the meter panel 18 in FIG. 1, by the processing in FIG. 2 in the second embodiment of the disclosure.

In the process of step ST6 in FIG. 2, the processor 21 may generate the alarm notification screen 53 of the removal of sulfur compounds in FIG. 15 and display the alarm notification screen 53 on the meter panel 18.

On the alarm notification screen 53 of the removal of sulfur compounds in FIG. 15, a removal-by-dealer button 54 and a removal-by-self-traveling button 55 may be displayed together with a message that gives an alarm about the removal of sulfur compounds. The removal-by-dealer button 54 is operable by the driver. The removal-by-self-traveling button 55 is provided for the removal by self-traveling by the driver themselves. This makes it possible for the driver to recognize that maintenance of the catalyst device for sulfur compounds is necessary to remove sulfur compounds.

Figure 16:
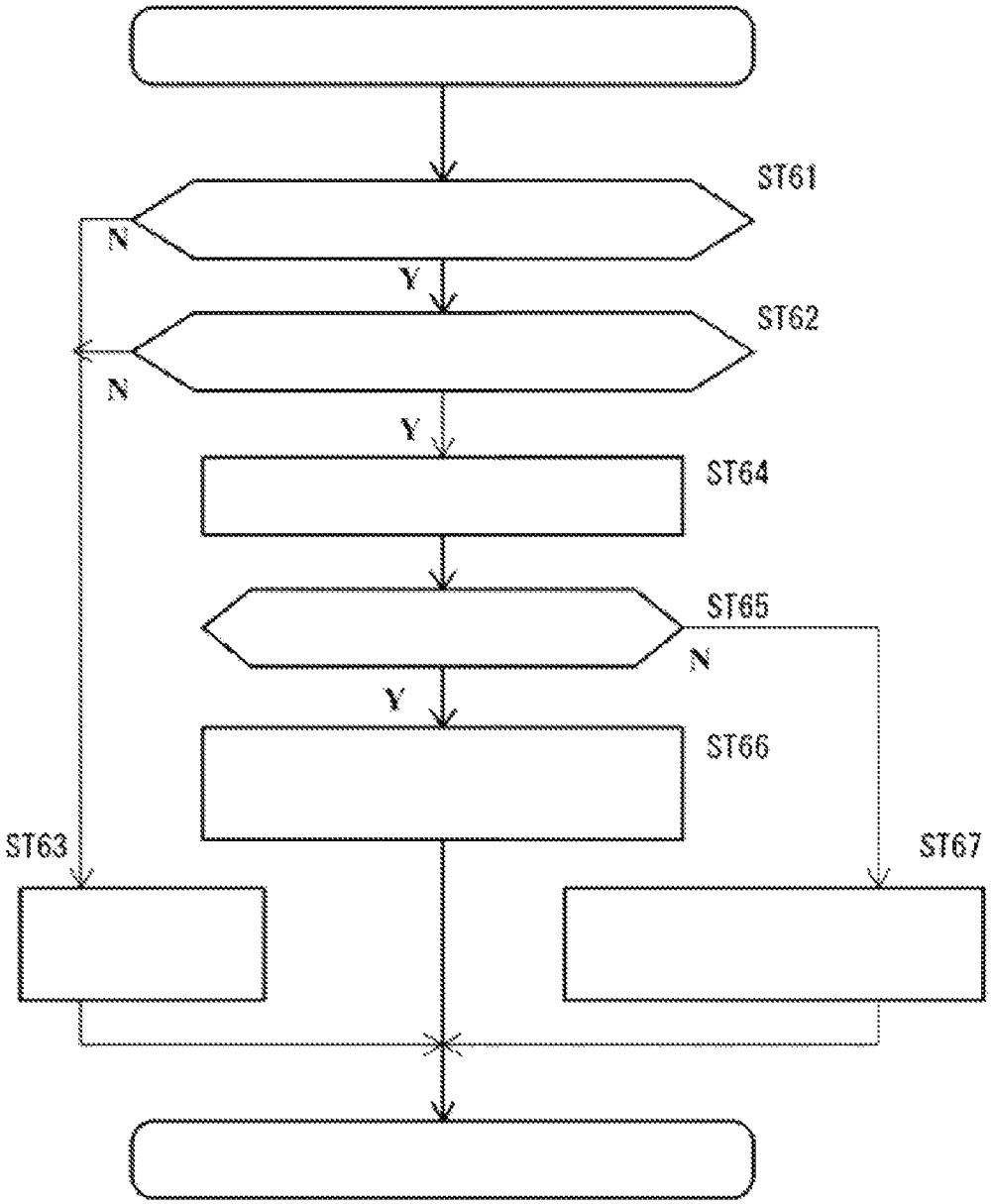
FIG. 16 is an example of a detailed flowchart of an end determination of a removal control of sulfur compounds, in the second embodiment of the disclosure.

FIG. 16 is an example of a detailed flowchart of an end determination of a removal control of sulfur compounds in the second embodiment of the disclosure.

FIG. 16 is, for example, a flowchart of the end determination of the removal control in an example suitable for the removal of sulfur compounds accumulating in the catalyst device while traveling on an expressway.

The processor 21 may make, for example, the end determination in FIG. 16, in step ST21 in FIG. 7.

In step ST61, the processor 21 may acquire the latest speed detected by the vehicle speed sensor, and determine whether or not the current speed of the vehicle is kept at 70 km/h or higher.

When the current speed of the vehicle is kept at 70 km/h or higher, the processor 21 may cause the flow to proceed to step ST62.

When the current speed of the vehicle is not kept at 70 km/h or higher, the processor 21 may cause the flow to proceed to step ST63.

In step ST62, the processor 21 may acquire, for example, the current data regarding the measured time duration of the removal from, for example, the timer 17, and determine whether or not the time duration of the removal since the start of the output control for removal has reached 5 minutes.

When the time duration of the removal has reached 5 minutes, the processor 21 may cause the flow to proceed to step ST64.

When the time duration of the removal has not reached 5 minutes, the processor 21 may cause the flow to proceed to step ST63.

In step ST63, the processor 21 may fix a determination that the removal control of sulfur compounds has not ended. Thereafter, the processor 21 may end the control.

In this case, in the process of step ST21 in FIG. 7, the processor 21 may determine that the removal control is not to be ended, and continue the output control for removal.

In step ST64, the processor 21 may acquire the detection results of the differential pressure sensors 10 to 12.

In step ST65, the processor 21 may determine whether or not the detection values by the differential pressure sensors 10 to 12 have been improved to the removal threshold value or smaller. Here, the removal threshold value basically suffices to be smaller than the alarm threshold value. In one example, the removal threshold value may be the detection values of the differential pressure sensors 10 to 12 in the state where little exhaust-containing substance has accumulated in the catalyst device.

When the detection values of the differential pressure sensors 10 to 12 are equal to or smaller than the removal threshold value, the processor 21 may cause the flow to proceed to step ST66.

When the detection values of the differential pressure sensors 10 to 12 are not equal to or smaller than the removal threshold value, the processor 21 may cause the flow to proceed to step ST67.

In step ST66, the processor 21 may determine that the exhaust-containing substance has been effectively removed by the removal control of sulfur compounds by self-traveling, and fix a determination that the removal control has ended successfully.

Moreover, the processor 21 may display, on the meter panel 18, that the removal control has ended successfully. Thereafter, the processor 21 may end the control.

In this case, in the process of step ST21 in FIG. 7, the processor 21 may determine that the removal control is to be ended, and refrain from carrying out the output control for removal after that.

Figure 17:
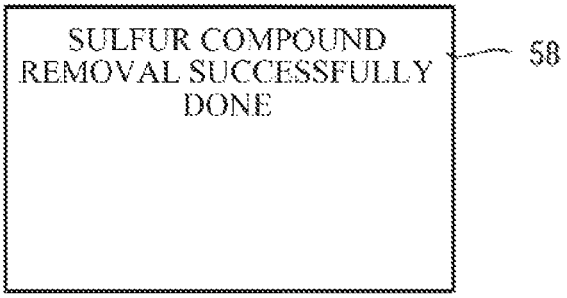
FIG. 17 illustrates an example of a success notification screen of the removal of sulfur compounds, to be displayed on the meter panel in FIG. 1, in processing in FIG. 16.

FIG. 17 is an example of a success notification screen 58 of the removal control of sulfur compounds. The success notification screen 58 is to be displayed on the meter panel 18 in FIG. 1, in the processing of FIG. 16.

On the success notification screen 58 of the removal of sulfur compounds in FIG. 17, a message may be displayed that notifies that the exhaust-containing substance has been effectively removed by the removal control of sulfur compounds by self-traveling, and that the removal control has been successful. This makes it possible for the driver to recognize a removal result of the removal control of sulfur compounds by self-traveling.

In step ST67, the processor 21 may determine that the exhaust-containing substance has not been effectively removed by the removal control of sulfur compounds by self-traveling, and fix a determination that the removal control has ended unsuccessfully.

The processor 21 may display, on the meter panel 18, that the removal control has ended unsuccessfully.

Moreover, the processor 21 may display the dealer information on the meter panel 18. Thereafter, the processor 21 may end the control.

In this case, in the process of step ST21 in FIG. 7, the processor 21 may determine that the removal control is to be ended, and refrain from carrying out the output control for removal after that.

Figure 18:
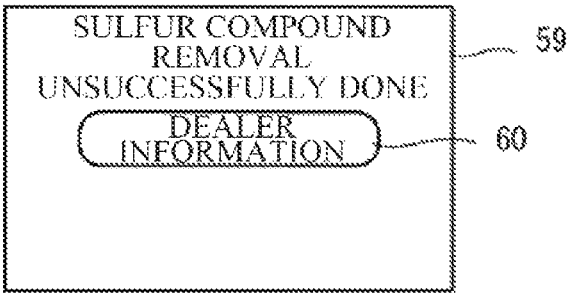
FIG. 18 illustrates an example of an unsuccess notification screen of the removal of sulfur compounds, to be displayed on the meter panel in FIG. 1, in the processing in FIG. 16.

FIG. 18 is an example of an unsuccess notification screen 59 of the removal of sulfur compounds. The unsuccess notification screen 59 is to be displayed on the meter panel 18 in FIG. 1, in the processing in FIG. 16.

On the unsuccess notification screen 59 of the removal process of sulfur compounds in FIG. 18, a message may be displayed that notifies that the exhaust-containing substance has not been effectively removed by the removal control of sulfur compounds by self-traveling, and that the removal control has been unsuccessful. This makes it possible for the driver to recognize that the exhaust-containing substance such as sulfur compounds accumulating in the catalyst device has not been sufficiently removed by the removal control of sulfur compounds by self-traveling.

Moreover, on the unsuccess notification screen 59 of the removal of sulfur compounds in FIG. 18, a dealer information button 60 may be displayed. The dealer information button 60 is operable by the driver. This makes it possible for the driver to recognize that further removal is necessary for the catalyst device.

As described, in the end determination of the removal control of sulfur compounds in FIG. 16, it is determined whether or not the time duration of the lean combustion in the engine 3 while the automobile 1 is traveling at the speed equal to or higher than the speed threshold value is at least equal to or longer than the time threshold value. In this case, the output control for removal to improve the accumulation state of the exhaust-containing substance in the catalyst device may be continuously or intermittently carried out until the condition for the end determination is satisfied.

Moreover, after carrying out the output control for removal at least once, the processor 21 may determine whether or not the accumulation state of the exhaust-containing substance in the catalyst device has been improved, based on the detection results of the differential pressure sensors 10 to 12. When the accumulation state of the exhaust-containing substance in the catalyst device has not been improved, the processor 21 may stop the output control for removal to improve the accumulation state of the exhaust-containing substance in the catalyst device. The processor 21 may display the unsuccess notification screen 59 of the removal, i.e., the third screen, on the meter panel 18. The third screen includes the notification of the removal by a dealer as a maintenance company. The third screen does not include a button that prompts the driver to carry out the removal by the driver themselves while traveling.

As described, in this embodiment, as with the forgoing embodiment, it is possible to determine the accumulation state of the exhaust-containing substance in the catalyst device to be used in the exhaust system 4 of the engine 3 of the automobile 1, based on the detection results of the differential pressure sensors 10 to 12, and to manage the accumulation state of the exhaust-containing substance.

In the automobile 1 according to such an embodiment, it is possible to keep the catalyst device clean for a long time and use the catalyst device even if the driver does not know about the necessity of the removal of the exhaust-containing substance accumulating in the catalyst device.

Moreover, it is possible to save the driver from determining by themselves whether or not the travel environment is suited to traveling for the removal of the exhaust-containing substance accumulating in the catalyst device. It is possible for the driver to keep the catalyst device clean for a long time and use the catalyst device.

Furthermore, during the output control for removal, the accumulation state, etc. of the catalyst device may be displayed on the meter panel 18. This makes it possible for the driver to deepen their understanding of the accumulation state, etc. of the catalyst device, and come to have little sense of discomfort. Even if the driver is guided to, for example, an unusual route, the driver is expected not to feel uncomfortable with the route. Moreover, the driver is expected to come to travel in accordance with the control by the processor 21 along, for example, a route guided for the removal. This leads to reduction in the burden on the driver.

In this embodiment, it is possible to optimally manage the catalyst device to be used in the exhaust system 4 of the engine 3 of the automobile 1 while reducing the burden on the driver.

Although some example embodiments of the disclosure have been described in the foregoing by way of example with reference to the accompanying drawings, the disclosure is by no means limited to the embodiments described above. It should be appreciated that modifications and alterations may be made by persons skilled in the art without departing from the scope as defined by the appended claims. The disclosure is intended to include such modifications and alterations in so far as they fall within the scope of the appended claims or the equivalents thereof.

The forgoing embodiments disclose the output control for removal suitable for each kind of the exhaust-containing substance.

The processor 21 may carry out the output control for removal that combines the forgoing embodiments together. For example, when the engine 3 is in operation continuously in the lean state at the speed of 70 km/h or higher for 30 minutes or longer, it is possible to efficiently keep the high exhaust gas temperature in the period. In this case, conceivably, the exhaust-containing substance accumulating in each of the catalyst devices provided in the automobile 1 is efficiently removed. Allowing the processor 21 to carry out such an output control for removal makes it possible to remove multiple kinds of the exhaust-containing substances such as $NO_X$, soot, and sulfur compounds from all the catalyst devices provided in the automobile 1.

The description of the forgoing embodiments mainly assumes a state in which the automobile 1 is traveling in accordance with operations by the driver.

The processor 21 of the automobile 1 may carry out the output control for removal similarly, even when the processor 21 controls the travel of the automobile 1 by assisting the driver in making the operations, or when the processor 21 controls the travel of the automobile 1 by automated driving that does not depend on the operations by the driver.

In the automated driving including such driver assistance, the processor 21 may replace the process of instructing the driver to make the accelerator operation in step ST20 in FIG. 7 with a process of notifying that the accelerator is automatically variable controlled.

In the forgoing embodiments, for the sake of convenience of explanation, description is given of an example where the automobile 1 includes a single ECU, and the single ECU carries out all the controls by the processor 21 described above.

However, the currently available automobile 1 usually includes multiple ECUs as control devices. The multiple ECUs are communicably coupled to one another through an in-vehicle network such as a controller area network (CAN). The multiple ECUs provided in the automobile 1 may cooperate to carry out all the controls described above. Moreover, the currently available automobile 1 often includes a control device for communication that communicates with, for example, a base station outside the vehicle. In this case, part or all of the controls described above may be carried out in a control device of the base station configured to communicate with the control device for communication. Furthermore, part or all of the controls described above may be carried out in a server apparatus configured to communicate with the control device for communication of the automobile 1 through the base station.

In one example, when the data regarding the automobile 1 is transmitted to outside the vehicle, as described, the data to be transmitted to outside the vehicle from the automobile 1 may be processed to inhibit an individual included in the data from being identified based on the data or in combination with other pieces of data. Moreover, in one example, the data to be transmitted and received by the communication may be encrypted or encoded.

The processor 21 illustrated in FIG. 1 is implementable by circuitry including at least one semiconductor integrated circuit such as at least one processor (e.g., a central processing unit (CPU)), at least one application specific integrated circuit (ASIC), and/or at least one field programmable gate array (FPGA). At least one processor is configurable, by reading instructions from at least one machine readable non-transitory tangible medium, to perform all or a part of functions of the processor 21. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the nonvolatile memory may include a ROM and a NVRAM. The ASIC is an integrated circuit (IC) customized to perform, and the FPGA is an integrated circuit designed to be configured after manufacturing in order to perform, all or a part of the functions of the processor 21 illustrated in FIG. 1.

The invention claimed is:

1. An exhaust catalyst management apparatus for a vehicle including an engine, an exhaust system connected to the engine, and a catalyst device disposed in the exhaust system, the exhaust catalyst management apparatus comprising:

a differential pressure sensor configured to detect a pressure difference between an input pressure of the catalyst device and an output pressure of the catalyst device; and a vehicle outside sensor configured to detect a parameter external to the vehicle;

an electronic control unit (ECU) including one or more processors coupled to the differential pressure sensor and the vehicle outside sensor, the ECU configured to execute an output control for removal in which an accumulation state of an exhaust-containing substance in the catalyst device is reduced, the output control for removal including:

determining the accumulation state based on the detected pressure difference, determining when a travel environment is suited to execute the output control for removal based on the detected parameter external to the vehicle, and reducing the accumulation state when (i) the vehicle is traveling, (ii) the determined accumulation state is greater than an accumulation threshold value, and (iii) the travel environment is determined to be suited to execute the output control for removal.

2. The exhaust catalyst management apparatus according to claim 1, wherein:

the catalyst device is configured to remove a nitrogen oxide and carbon, or a sulfur compound from an exhaust gas of the engine, the travel environment is determined to be suited to execute the output control for removal when the vehicle outside sensor determines that the vehicle is traveling on an expressway, and the reducing of the accumulation state includes an expressway output control which brings the engine into a lean state operation so as to raise a temperature of the exhaust gas when the vehicle is traveling above a speed threshold value.

3. The exhaust catalyst management apparatus according to claim 2, wherein:

the travel environment is determined to be suited to execute the output control for removal when the vehicle outside sensor determines that the vehicle is traveling on a general road, and the reducing of the accumulation state further includes a general-road output control which brings the engine into the lean state operation so as to raise the temperature of the exhaust gas when the vehicle starts from a stoppage.

4. The exhaust catalyst management apparatus according to claim 2, wherein:

the reducing of the accumulation state is executed until a duration of the lean state operation exceeds a time threshold value.

5. The exhaust catalyst management apparatus according to claim 4, wherein:

the ECU further includes one or more memories operatively connected to the one or more processors, and the determined accumulation state is recorded in the one or more memories.

6. The exhaust catalyst management apparatus according to claim 5, wherein:

the vehicle further includes a display device, and the ECU is further configured to display the determined accumulation state on the display device during the output control for removal.

7. The exhaust catalyst management apparatus according to claim 6, wherein:

the engine is a direct injection gasoline engine configured to selectively operate in the lean state operation.

8. The exhaust catalyst management apparatus according to claim 1, wherein:

the catalyst device is configured to remove a nitrogen oxide and carbon, or a sulfur compound from an exhaust gas of the engine, the travel environment is determined to be suited to execute the output control for removal when the vehicle outside sensor determines that the vehicle is traveling on a general road, and the reducing of the accumulation state includes a general-road output control which brings the engine into a lean state operation so as to raise a temperature of the exhaust gas when the vehicle starts from a stoppage.

9. The exhaust catalyst management apparatus according to claim 8, wherein:

the travel environment is determined to be suited to execute the output control for removal when the vehicle outside sensor determines that the vehicle is traveling on an expressway, the reducing of the accumulation state further includes an expressway output control which brings the engine into the lean state operation when the vehicle is traveling above a speed threshold value, and the reducing of the accumulation state is executed until a duration of the lean state operation exceeds a time threshold value.

10. The exhaust catalyst management apparatus according to claim 9, wherein:

the ECU further includes one or more memories operatively connected to the one or more processors, and the determined accumulation state is recorded in the one or more memories.

11. The exhaust catalyst management apparatus according to claim 10, wherein:

the vehicle further includes a display device, and the ECU is further configured to display the determined accumulation state on the display device during the output control for removal.

12. The exhaust catalyst management apparatus according to claim 11, wherein:

the engine is a direct injection gasoline engine configured to selectively operate in the lean state operation.

13. The exhaust catalyst management apparatus according to claim 1, wherein:

the reducing of the accumulation state includes bringing the engine into a lean state operation so as to raise an exhaust gas temperature when the vehicle is traveling above a speed threshold value, and the reducing of the accumulation state is executed until a duration of the lean state operation exceeds a time threshold value.

14. The exhaust catalyst management apparatus according to claim 13, wherein:

the ECU further includes one or more memories operatively connected to the one or more processors, and the determined accumulation state is recorded in the one or more memories.

15. The exhaust catalyst management apparatus according to claim 14, wherein:

the vehicle further includes a display device, and the ECU is further configured to display the determined accumulation state on the display device during the output control for removal.

16. The exhaust catalyst management apparatus according to claim 15, wherein:

the engine is a direct injection gasoline engine configured to selectively operate in the lean state operation.

* * * * *